US012502588B1

(12) United States Patent
Mauro

(10) Patent No.: US 12,502,588 B1
(45) Date of Patent: Dec. 23, 2025

(54) INTERCHANGEABLE BACKBOARD AND MOUNTING HARDWARE FOR A BASKETBALL HOOP

(71) Applicant: BRILLIANT VISION, LLC, Des Moines, IA (US)

(72) Inventor: Daniel E. Mauro, Johnston, IA (US)

(73) Assignee: BRILLIANT VISION, LLC, Des Moines, IA (US)

( * ) Notice: Subject to any disclaimer, the term of this patent is extended or adjusted under 35 U.S.C. 154(b) by 0 days.

(21) Appl. No.: 19/039,564

(22) Filed: Jan. 28, 2025

(51) Int. Cl.
*A63B 63/08* (2006.01)

(52) U.S. Cl.
CPC ..... *A63B 63/083* (2013.01); *A63B 2063/086* (2013.01)

(58) Field of Classification Search
CPC ... A63B 63/083; A63B 69/0071; A63B 63/00; A63B 63/08; A63B 21/1645; A63B 1052/086
See application file for complete search history.

(56) References Cited

U.S. PATENT DOCUMENTS 1,522,957 A * 1/1925 Kennedy ..... A63B 63/083 248/315
2,596,543 A * 5/1952 Fox ..... A63B 63/083 248/315
3,814,359 A * 6/1974 Powell ..... B65B 67/12 473/487
4,365,802 A 12/1982 Ehrat
4,372,555 A * 2/1983 Sorensen ..... A63B 63/083 473/481
4,468,027 A * 8/1984 Pangburn ..... A63B 63/083 473/481
4,473,957 A * 10/1984 Faulkner ..... B25H 7/04 33/666
4,815,734 A * 3/1989 Verhulst ..... A63B 63/083 473/488
4,887,812 A * 12/1989 Moormann ..... A63B 63/083 473/487
5,007,637 A * 4/1991 Foley ..... A63B 63/083 473/487
5,022,649 A 6/1991 Traub et al.
5,138,134 A * 8/1992 Ellison ..... A47G 1/0616 392/436

(Continued)

FOREIGN PATENT DOCUMENTS

CN 106267759 A 1/2017
KR 102271910 B1 7/2021

OTHER PUBLICATIONS

"Mini Basketball Hoop (Replaceable Backboard Cards Design) Over The Door Mini Hoop Basketball Gift/Door Mount Wall-Mounted". Product sold on Amazon.

*Primary Examiner* — Eugene L Kim
*Assistant Examiner* — Amir A Klayman
(74) *Attorney, Agent, or Firm* — McKee, Voorhees & Sease, PLC

(57) ABSTRACT

A mounting system for a basketball hoop including the capability of rotating the basketball hoop between a first position and a second position, interchangeability of backboards for use with the basketball hoop, hanging picture frames with pictures therein from a mount of the basketball hoop, and increasing verticality of mounting apertures in a wall to produce a truly level basketball hoop.

1 Claim, 31 Drawing Sheets

(56) References Cited

U.S. PATENT DOCUMENTS

| | | | | |
|---|---|---|---|---|
| 5,393,048 | A * | 2/1995 | Rodriguez-Ferre | A63B 71/023 473/483 |
| 5,779,569 | A | 7/1998 | Townsend et al. | |
| 5,893,809 | A * | 4/1999 | Coats | A63B 63/083 473/486 |
| 6,739,065 | B2 * | 5/2004 | Hofmeister | A47G 1/205 33/666 |
| 7,175,551 | B1 | 2/2007 | Hamilton | |
| 7,216,841 | B2 * | 5/2007 | Dodig, Jr. | A47G 1/20 248/475.1 |
| 7,794,342 | B2 | 9/2010 | Connerley et al. | |
| 9,032,637 | B2 * | 5/2015 | Propp | B25H 7/04 33/669 |
| 9,151,606 | B2 * | 10/2015 | Silberberg | G01C 9/28 |
| 9,775,450 | B2 * | 10/2017 | Will | F16B 45/00 |
| 10,004,964 | B2 * | 6/2018 | Chu | A63B 63/083 |
| 10,398,956 | B2 * | 9/2019 | Remaklus | A63B 63/083 |
| 10,441,098 | B2 * | 10/2019 | Bruno | B25C 3/008 |
| D870,830 | S * | 12/2019 | Mills | D21/701 |
| 2004/0035035 | A1 * | 2/2004 | Morris | G09F 23/00 40/611.11 |
| 2018/0099193 | A1 * | 4/2018 | Shen | A63B 63/083 |
| 2019/0201804 | A1 * | 7/2019 | Khalus | A63H 33/046 |
| 2022/0088452 | A1 * | 3/2022 | Wu | A63B 69/0071 |
| 2024/0165472 | A1 * | 5/2024 | Seitz | A63B 63/083 |

* cited by examiner

INTERCHANGEABLE BACKBOARD AND MOUNTING HARDWARE FOR A BASKETBALL HOOP

TECHNICAL FIELD

The present disclosure relates generally to a miniature basketball hoop for installation in homes, apartments, work environments, etc. having applications in at least the Arts, Entertainment, and Recreation industry and/or sector. More particularly, but not exclusively, the present disclosure relates to an interchangeable backboard and mounting hardware for a basketball hoop for recreational use.

BACKGROUND

The background description provided herein gives context for the present disclosure. Work of the presently named inventors, as well as aspects of the description that may not otherwise qualify as prior art at the time of filing, are neither expressly nor impliedly admitted as prior art.

Miniature basketball hoops for personal use within a building (not a gym) often require being set up on a door or wall that require interaction with the door or wall in a way that causes small amounts of damage to the building. This damage can come in the form of holes in the wall, chipped paint, dents, and/or scratches on structure of the building which in aggregate can be substantial if the use of the miniature basketball hoop is excessive or if there are multiple instances of installation which would be the case for apartments and/or college dorms. For an apartment wall that has multiple miniature basketball hoops nailed onto the apartment wall by multiple successive individuals who live in the apartment, this can result in damage to the apartment wall which can be aesthetically displeasing and reduce apartment value, especially in combination with pictures and/or posters hung on the apartment wall which also create holes in the apartment wall or remove paint from the apartment wall due to adhesives.

As such, there is a need in the art for providing a miniature basketball hoop that will reduce an amount of damage done to standing structures within a building so as to retain apartment value and reduce reparation costs.

SUMMARY

The following objects, features, advantages, aspects, and/or embodiments are not exhaustive and do not limit the overall disclosure. No single embodiment need provide each and every object, feature, or advantage. Any of the objects, features, advantages, aspects, and/or embodiments disclosed herein can be integrated with one another, either in full or in part.

It is a primary object, feature, and/or advantage of the present disclosure to improve on or overcome the deficiencies in the art.

It is a further object, feature, and/or advantage of the present disclosure to reduce damage to upstanding structures such as walls within apartment buildings with relation to the use of miniature basketball hoops.

It is preferred the apparatus be safe, cost effective, and durable.

At least one embodiment disclosed herein comprises a distinct aesthetic appearance. Ornamental aspects included in such an embodiment can help capture a consumer's attention and/or identify a source of origin of a product being sold. Said ornamental aspects will not impede functionality of basketball system.

Methods can be practiced which facilitate use, manufacture, assembly, maintenance, and repair of the basketball system which accomplish some or all of the previously stated objectives.

The mounting system can be incorporated into systems or kits which accomplish some or all of the previously stated objectives.

According to some aspects of the present disclosure, a basketball system, that includes a mount for attaching to an upstanding structure which includes: a mounting base including a top and a bottom: an alignment portion extending from a first side of the mounting base, the alignment portion including substantially straight sides: at least two apertures extending through the mounting base, the at least two apertures defining a line perpendicular to a surface of the top of the mounting base; and at least two hook holders positioned at the bottom of the mounting base extending from a second direction of the mount, the at least two hook holders each comprising substantially an L-shape. The basketball system further includes a basketball hoop including: a base portion: a pair of cylindrical protrusions extending substantially parallel from the base portion on a first side and a second side of the base portion: a rim; and a frame connecting the rim to the base portion. Wherein, the pair of cylindrical portions are insertable into an area formed by the L-shape of the at least two hook holders.

According to some additional aspects of the present disclosure, the basketball system further includes a plate for insertion in between the mount and the base portion of the basketball hoop.

According to some additional aspects of the present disclosure, the basketball system further includes a plate receiving portion within the mounting base for receiving the plate, wherein the plate is made of ferromagnetic material.

According to some additional aspects of the present disclosure, the basketball system further includes a magnet housing positioned on the base portion of the basketball hoop, and a cap insertable atop the magnet housing for removing or retaining a magnet within the magnet housing.

According to some additional aspects of the present disclosure, the basketball hoop is rotatable between a first position and a second position via the pair of cylindrical protrusions being positioned within the at least two hook holders.

According to some additional aspects of the present disclosure, the basketball system further includes cutouts in the base portion of the basketball hoop aligned with the at least two apertures of the mount so as to reduce interference of the basketball hoop with potential fasteners positioned through the at least two apertures of the mount.

According to some additional aspects of the present disclosure, the basketball system further includes fasteners to be positioned through the at least two apertures of the mount, wherein the fasteners are either of screws or nails.

According to some additional aspects of the present disclosure, the cap is hollow.

According to some additional aspects of the present disclosure, a distance from a most distal end of the at least two hook hangers from a surface of the mounting base is a shorter distance than a distance from the surface of the mounting base to a back surface of the alignment portion.

According to some additional aspects of the present disclosure, the basketball system further includes weight reducing portions positioned adjacent to the hook holders.

According to some additional aspects of the present disclosure, the frame comprises a stop on each side of the frame such that the stop on each side of the frame contacts each of the at least two hook holders when the pair of cylindrical protrusions of the basketball hoop are placed in the at least two hook holders.

According to some additional aspects of the present the basketball hoop includes weight reduction portions adjacent to the pair of cylindrical protrusions.

According to some additional aspects of the present disclosure, the basketball system further includes a plurality of magnets positioned in the magnet housing positioned such that magnetic fields of the magnet are not centralized or localized in a central point, but spread out within the magnet housing.

According to some additional aspects of the present disclosure, the basketball system further includes a placement guide for marking fastener points on the upstanding structure comprising: a placement base: a flange extending a first direction from the placement base:

a leveler positioned on the flange; and at least two locator sleeves extending substantially orthogonal from the placement base in the first direction, wherein the at least two locator sleeves define a line perpendicular to the leveler.

According to some additional aspects of the present disclosure, the basketball system further includes apertures extending through the at least locator sleeves.

According to some additional aspects of the present disclosure, the basketball system further includes an alignment guide for assisting mounting of the mount to the upstanding structure in a level manner comprising: an alignment base: a flange extending a first direction from the alignment base: a leveler positioned on the flange; and a cutout within the alignment base shaped to surround the alignment portion of the mount and to slidingly engage the alignment portion.

According to some additional aspects of the present disclosure, the basketball system further includes a backboard comprising a rectangular shape, wherein the backboard includes a cutout shaped to surround the alignment portion of the mount and to slidingly engage the alignment portion.

According to some additional aspects of the present disclosure, the mount further includes right-angle protrusions at the top of the mounting base.

According to some other aspects of the present disclosure, a basketball mounting kit, including a placement guide comprising: a placement base: a flange extending a first direction from the placement base: a leveler positioned on the flange; and at least two locator sleeves extending substantially orthogonal from the placement base in the first direction, wherein the at least two locator sleeves define a line perpendicular to the leveler: a mount for attaching to an upstanding structure comprising: a mounting base including a top and a bottom:

an alignment portion extending from a first side of the mounting base, the alignment portion including substantially straight sides: at least two apertures extending through the mounting base, the at least two apertures defining a line perpendicular to a surface of the top of the mounting base; and at least two hook holders positioned at the bottom of the mounting base extending from a second direction of the mount, the at least two hook holders each comprising substantially an L-shape: an alignment guide comprising: an alignment base: a flange extending a first direction from the alignment base: a leveler positioned on the flange; and a cutout within the alignment base shaped to surround the alignment portion of the mount and to slidingly engage the alignment portion a basketball hoop comprising: a base portion: a pair of cylindrical protrusions extending substantially parallel from the base portion on a first side and a second side of the base portion: a rim: a frame connecting the rim to the base portion; and a magnet housing positioned on the base portion with a magnet positioned therein.

According to some other aspects of the present disclosure, a method for mounting a basketball system, which includes locating a sturdy portion of an upstanding surface and then placing a placement guide on the sturdy portion. The method further includes leveling the placement guide using a leveler, and then marking fastener points on the sturdy portion by inserting a marking agent through apertures within locator sleeves disposed on the placement guide. The method further includes placing an alignment guide on the sturdy portion of the upstanding structure, leveling the alignment guide, placing a mount in a receiving portion of the alignment guide, and then securing the mount to the upstanding structure with fasteners extending into the fastener points. The method further includes removing the alignment guide, and placing a basketball hoop on the mount.

These and/or other objects, features, advantages, aspects, and/or embodiments will become apparent to those skilled in the art after reviewing the following brief and detailed descriptions of the drawings. The present disclosure encompasses (a) combinations of disclosed aspects and/or embodiments and/or (b) reasonable modifications not shown or described.

BRIEF DESCRIPTION OF THE DRAWINGS

Several embodiments in which the present disclosure can be practiced are illustrated and described in detail, wherein like reference characters represent like components throughout the several views. The drawings are presented for exemplary purposes and may not be to scale unless otherwise indicated.

An artisan of ordinary skill in the art need not view, within isolated figure(s), the near infinite distinct combinations of features described in the following detailed description to facilitate an understanding of the present disclosure.

DETAILED DESCRIPTION

The present disclosure is not to be limited to that described herein. Mechanical, electrical, chemical, procedural, and/or other changes can be made without departing from the spirit and scope of the present disclosure. No features shown or described are essential to permit basic operation of the present disclosure unless otherwise indicated.

Figure 1A:
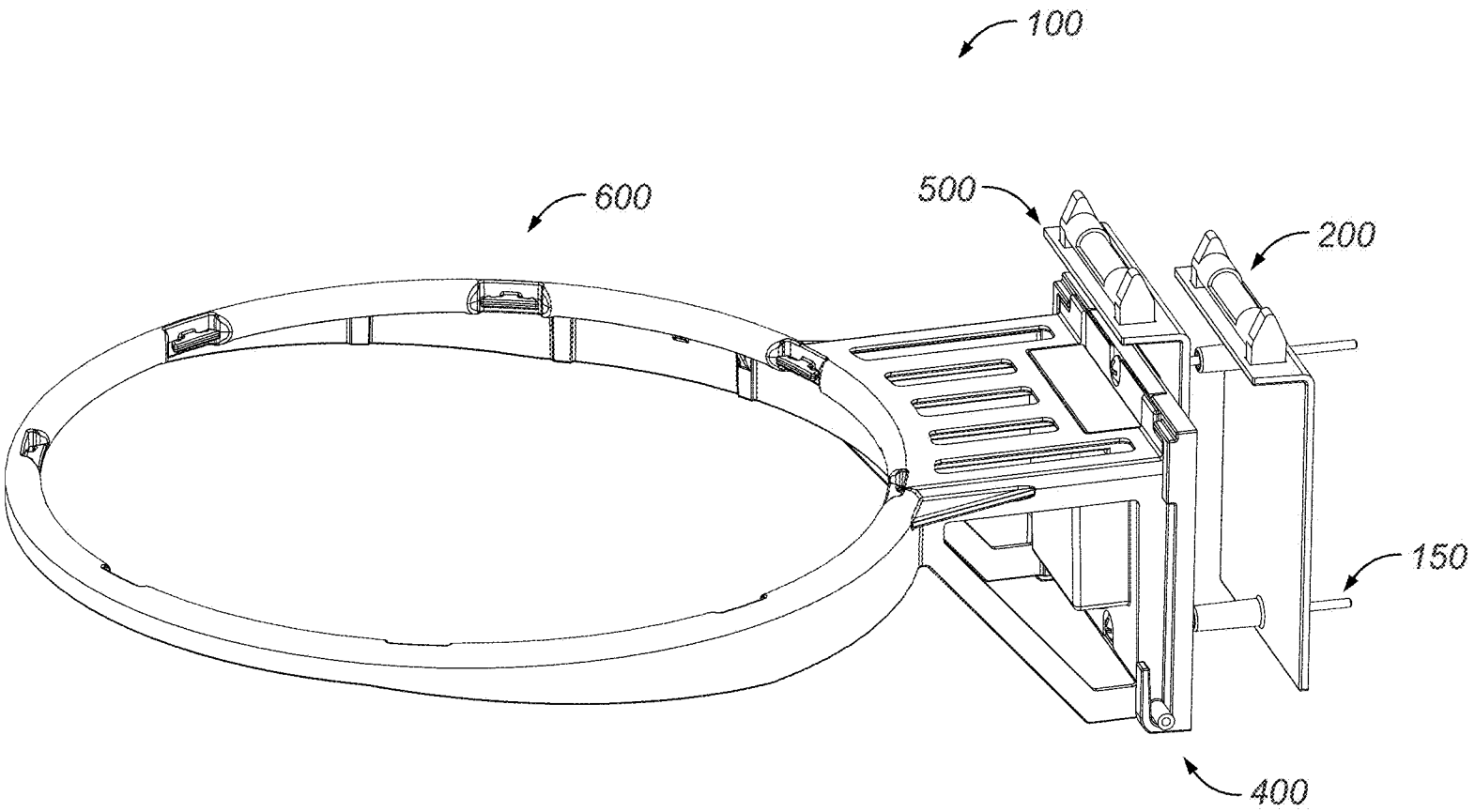
FIG. 1A shows a perspective view of a mounting system.
Figure 1B:
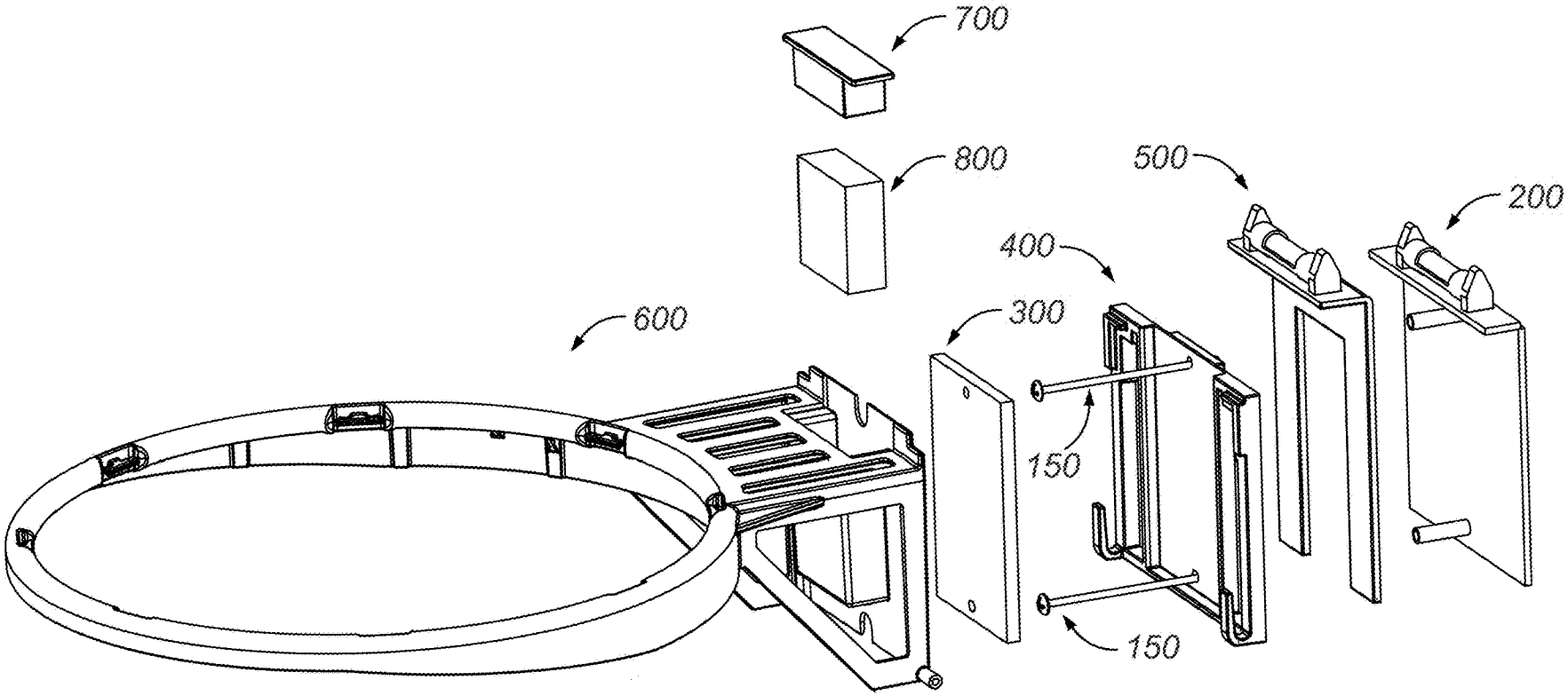
FIG. 1B shows an exploded view of the system of FIG. 1A.

FIGS. 1A and 1B depict an example of a mounting system 100 of the present disclosure. The mounting system 100 includes fasteners 150, a placement guide 200, a plate 300, a mount 400, an alignment guide 500, a basketball hoop 600, a cap 700, and a magnet 800.

To assemble the mounting system 100, the placement guide 200 receives fasteners 150 through first the plate 300 and then the mount 400, which may be straightened by the alignment guide 500. The basketball hoop 600 may interface with the plate 300 and operatively connect to the mount 400 for use therewith. Further, the cap 700 may assist with housing the magnet 800 in the basketball hoop 600.

The mounting system 100 is not intended to remain entirely assembled during use. Rather, the placement guide 200 assists with getting proper leveling for the basketball hoop 600 and will be removed for when the basketball hoop 600 is in use. Similarly, the alignment guide 500 will also be removed when the basketball hoop 600 is in use. As such, when the basketball hoop 600 is in use, remaining components may include the plate 300, the mount 400, the basketball hoop 600, the cap 700, and the magnet 800. As will be discussed in greater detail later, the mount 400 may be used on its own without the basketball hoop 600. In which case the only components in use would include the fasteners 150 and the mount 400 when the mount 400 is in use without the basketball hoop 600.

Before describing how to use the mounting system 100 and the benefits thereof. FIGS. 2A-8 will be described in detail.

Figure 2A:
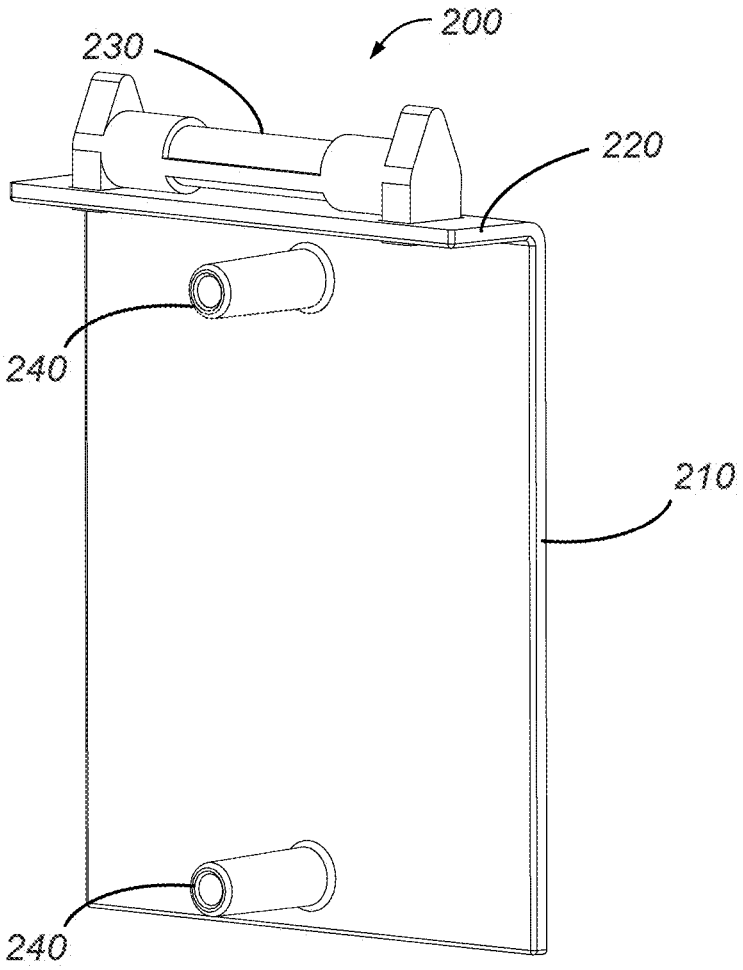
FIG. 2A shows a first perspective view of a placement guide for use in the system of FIG. 1A.
Figure 2B:
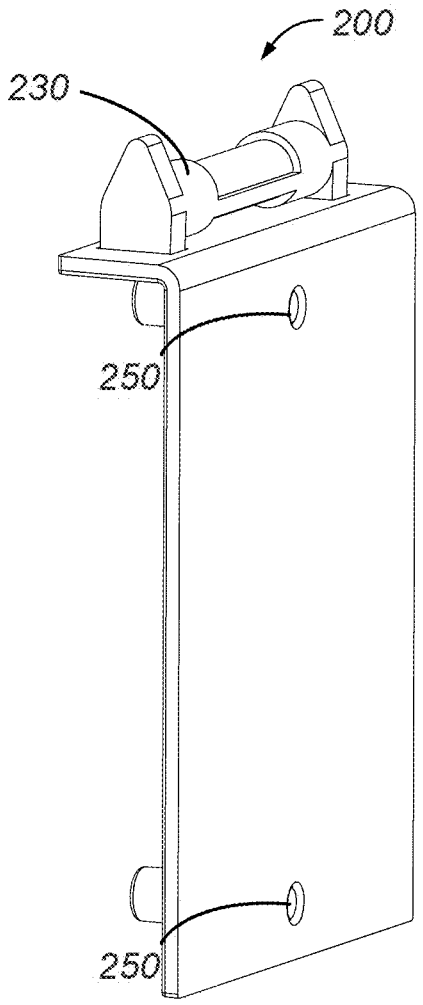
FIG. 2B shows a second perspective view of the placement guide of FIG. 2A.
Figure 2C:
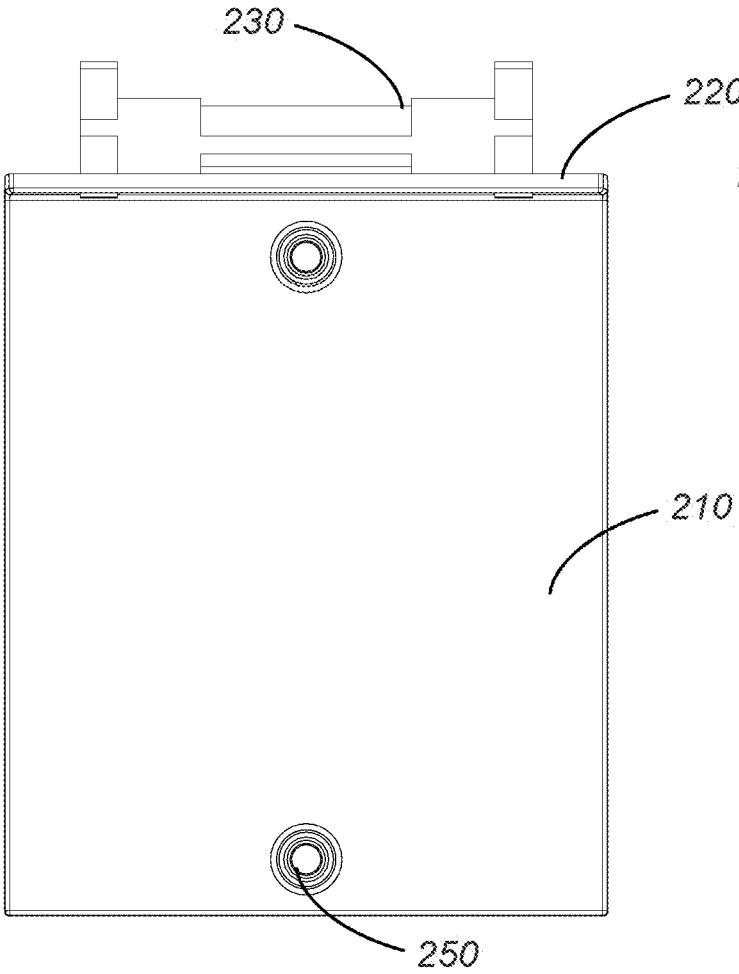
FIG. 2C shows a first elevation view of the placement guide.
Figure 2D:
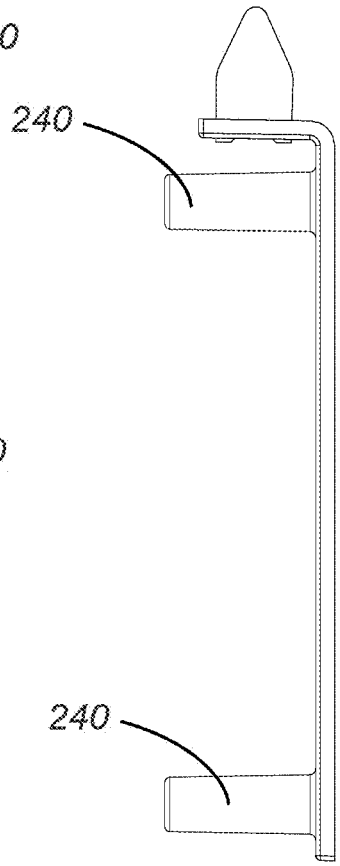
FIG. 2D shows a second elevation view of the placement guide.
Figure 2E:
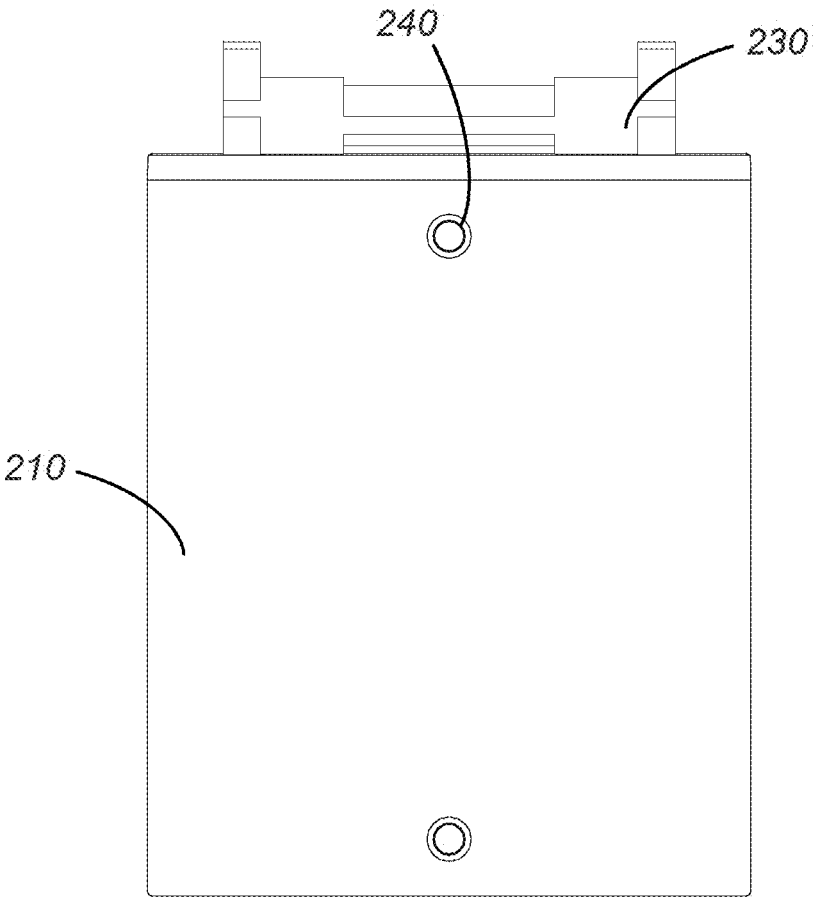
FIG. 2E shows a third elevation view of the placement guide.
Figure 2F:
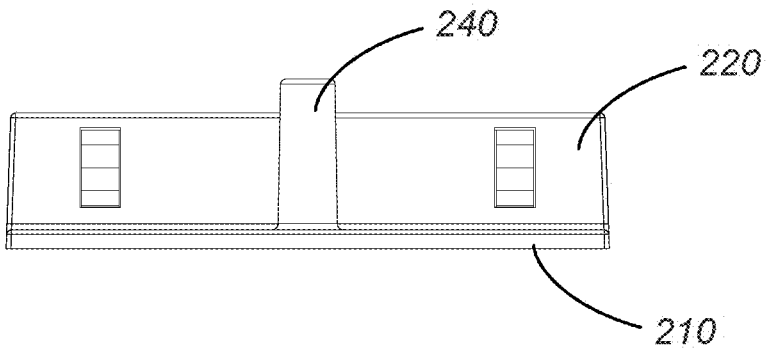
FIG. 2F shows a plan view of the placement guide.

FIGS. 2A-2F depict various views of the placement guide 200. The placement guide 200 includes a placement base 210, a flange 220, a leveler 230, and a pair of locator sleeves 240 with apertures 250 therethrough. FIGS. 2A-2B show two different perspective views of the placement guide 200. FIG. 2C shows a first elevation view of the placement guide 200 and may be termed as a front view of the placement guide 200. FIG. 2D shows a second elevation view of the placement guide 200 and may be termed as a view of a right side of the placement guide 200. FIG. 2E is a third elevation view of the placement guide 200 and may be termed as a back view of the placement guide 200. FIG. 2F is a plan view of the placement guide 200 and may be termed a bottom view of the placement guide 200.

The placement base 210 of the placement guide 200 is flat so as to interface substantially flush with a flat surface. Extending from a first end of the placement base 210 is the flange 220. The flange 220 may extend substantially orthogonal to the placement base 210. Placed on a surface of the flange 220 is the leveler 230. The leveler 230 may include fasteners to attach it to the flange 220 such as hook and loop materials, adhesives, nails, screws, bolts, nuts, lock-in-place rotational flange inserts, etc. Alternatively, the leveler 230 may be permanently affixed to the flange 220. Alternatively still, the leveler 230 may be inserted into slide-in-inserts of protrusions extending outwardly from the flange 220.

Further, the placement guide 200 may include the locator sleeves 240 extending substantially orthogonal from the placement base 210. The locator sleeves 240 may be substantially cylindrical with apertures 250 extending therethrough. Should a theoretical perpendicular-line be drawn extending from the leveler 230 down onto the placement base 210, the locator sleeves 240 would be positioned along the theoretical extending perpendicular-line so as to form a line that is perpendicular to the leveler 230 when intersecting through both of the locator sleeves 240.

The flange 220 may be positioned at various positions on the placement base 210. For example, although the flange 220 is shown to extend from the first end of the placement base 210, the flange 220 may extend from a second end of the placement base 210 opposite the first end. In such a case, the flange 220 would be positioned at a bottom of the placement base 210 rather than a top (as currently shown), and the leveler 230 if seen from a perspective of FIG. 2E would instead cover a portion of the placement base 210 from being seen rather than being able to see an entirety of the placement base 210 as FIG. 2E currently shows. As such, in an instance of placing the flange 220 at the bottom of the placement base 210 rather than the top, the locator sleeves 240 would be adjusted upward to accommodate for the leveler 230 being placed above the flange 220. A further example of where the flange 220 may be placed is in between the locator sleeves 240. A further example still is from a right or a left side of the placement base 210. What is important is that the flange 220 is positioned such that the leveler 230 will enable vertical alignment of the locator sleeves 240 when positioning the placement guide 200 on a flat surface such as a wall or a door.

To use the placement guide 200, an operator locates a sturdy portion of a wall such as an area with a stud or a cement wall and preferably on a flat surface of the wall, and then places the placement guide 200 on the sturdy portion of the wall. The operator then levels the placement guide 200 by utilizing the leveler 230 to straighten the placement guide 200, and then places fastener points on the sturdy portion of the wall by inserting a marking agent through the locator sleeves 240. When the marking agent is inserted through the apertures 250, two marks will be positioned on the wall that are essentially vertical. The marking agent may be nails, screws, markers, pencils, etc. so as to penetrate or color the wall. Accuracy of the fastener points on the wall placed by the marking agent (accuracy of true verticality) will be increased by first increasing a length of the locator sleeves 240 and reducing a diameter of the apertures 250 within the locator sleeves 240 to more perfectly fit the marking agent therethrough. Ensuring these characteristics will contribute to reducing a likelihood of the marketing agent from tilting off-center when the fastener point is marked with the marking agent through the locator sleeves 240. Importantly, there may be more than two locator sleeves 240. There may be three, four, etc. wherein an amount of locator sleeves 240 correlates to how many fastening points the mount 400 will have when interfacing with the wall. Thus, if there are three locator sleeves 240 on the placement guide 200, then there will be three fastening points on the mount 400 to connect with the wall.

Figure 3A:
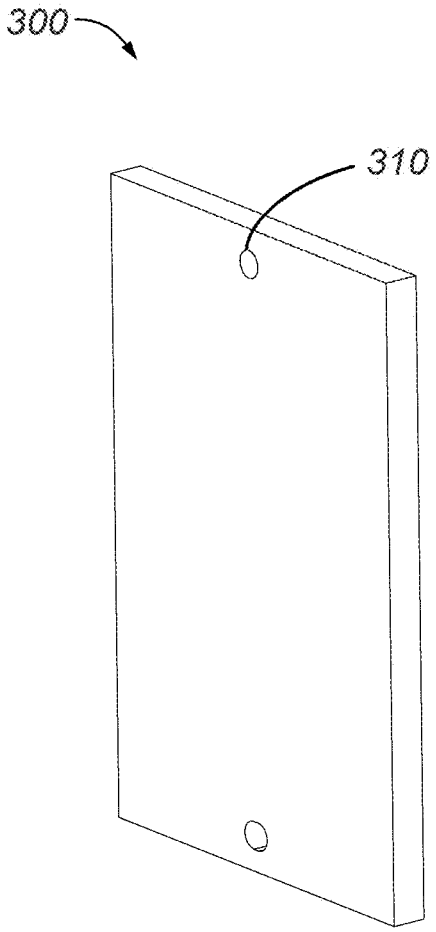
FIG. 3A shows a perspective view of a plate for use in the system of FIG. 1A.
Figure 3B:
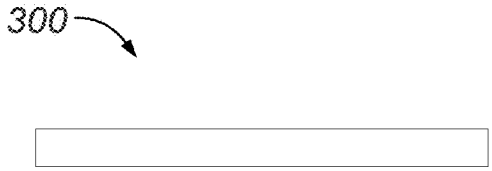
FIG. 3B shows a plan view of the plate of FIG. 3A.
Figure 3C:
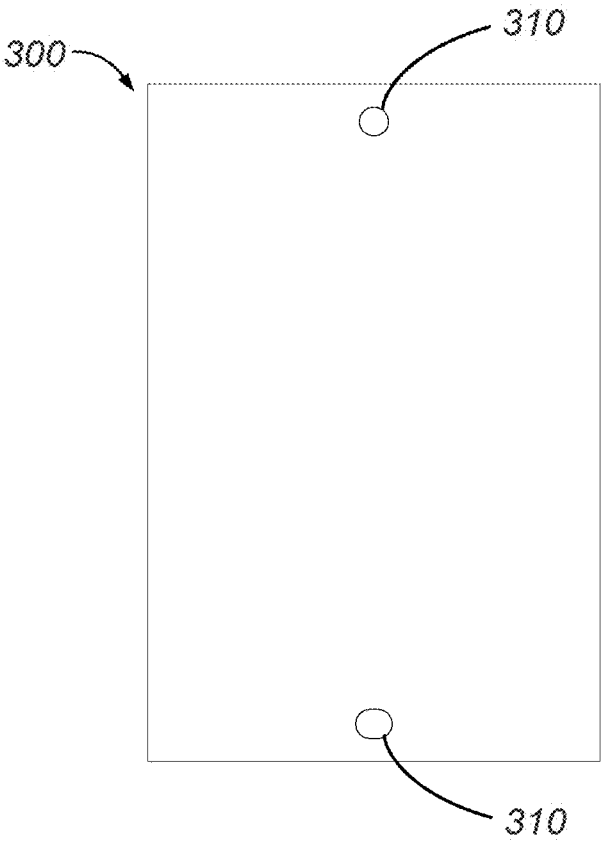
FIG. 3C shows a first elevation view of the plate.
Figure 3D:
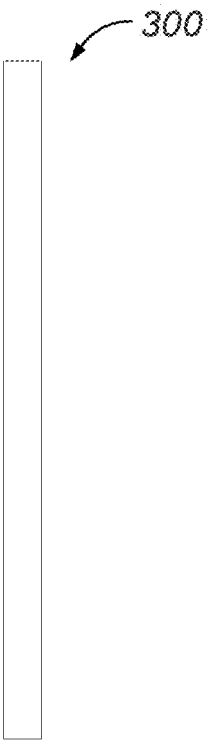
FIG. 3D shows a second elevation view of the plate.

FIGS. 3A-3D show the plate 300. The plate 300 includes apertures 310 extending through the plate 300. FIG. 3A shows a perspective view of the plate 300. FIG. 3B shows a plan view of the plate 300. FIG. 3C shows a first elevation view of the plate 300. FIG. 3D shows a second elevation view of the plate 300. The plan view of the plate 300 shown may be termed a top view of the plate 300, and is identical to a bottom view of the plate. The first elevation view may be termed a front view of the plate 300 and the second elevation view may be termed a side or right view of the plate 300. The first elevation view is identical to a back view of the plate 300, and the right view is identical to a left view of the plate 300. The apertures 310 are configured to be positioned concentric with the locator sleeves 240 on the placement guide 200. As such, if there are more than two locator sleeves 240 on the placement guide 200, the plate 300 will have an equal amount of additional apertures 310 so as to match the number of locator sleeves 240. As shown in FIG. 3C, a top aperture 310 on the plate 300 is substantially circular, whereas a bottom aperture 310 on the plate 300 is substantially stadium shaped. This stadium shape allows for a little play in movement of the plate 300 when attached to the wall. The plate 300 is made of a ferromagnetic metal. By way of example and not of limitation, steel is one such example material.

Figure 4A:
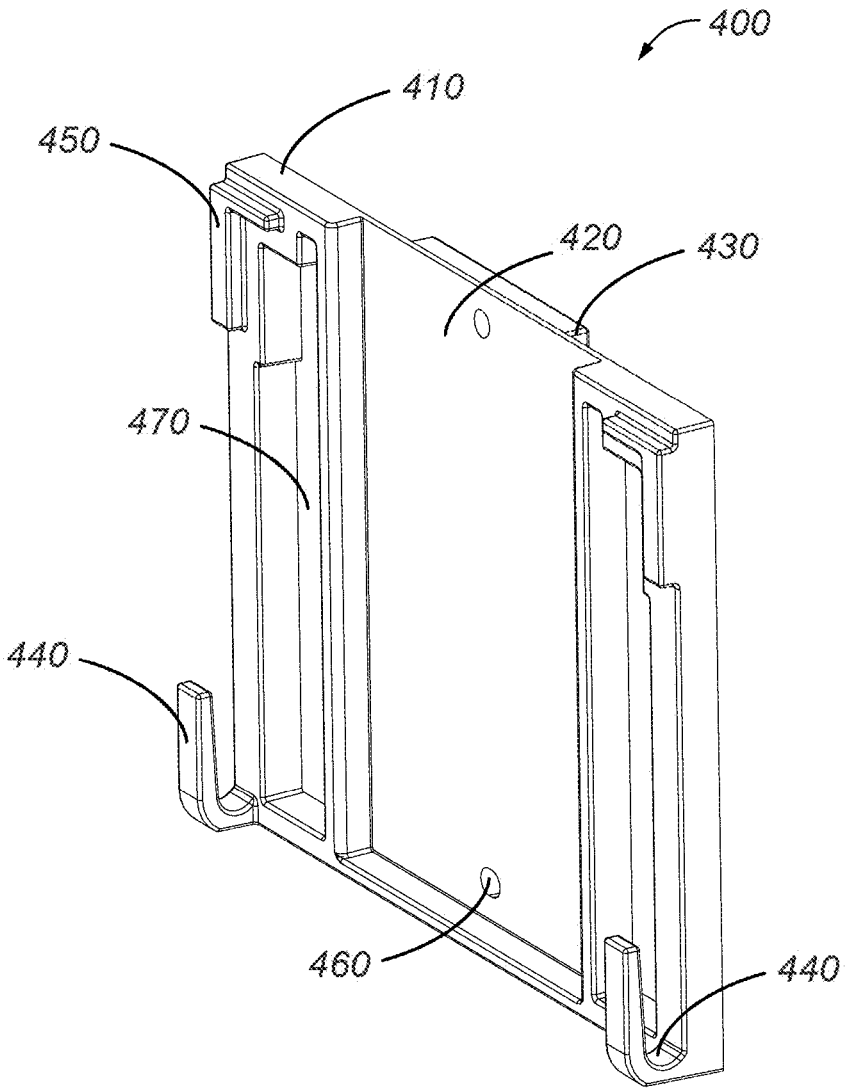
FIG. 4A shows a perspective view of a mount for use in the system of FIG. 1A.
Figure 4B:
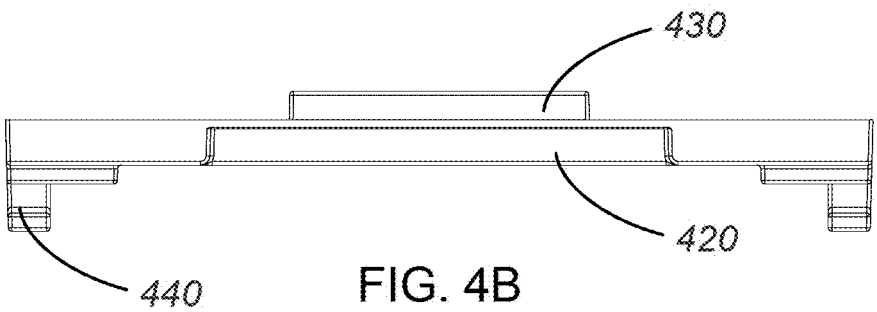
FIG. 4B shows a first plan view of the mount of FIG. 4A.
Figure 4C:
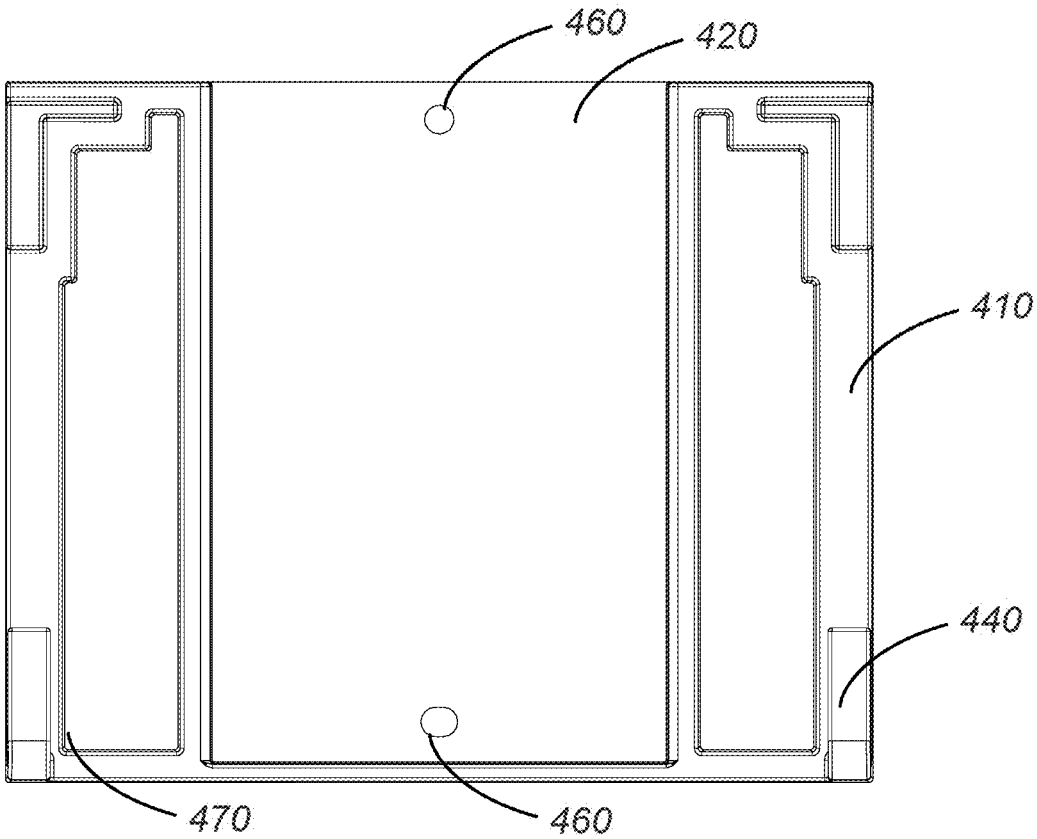
FIG. 4C shows a first elevation view of the mount.
Figure 4D:
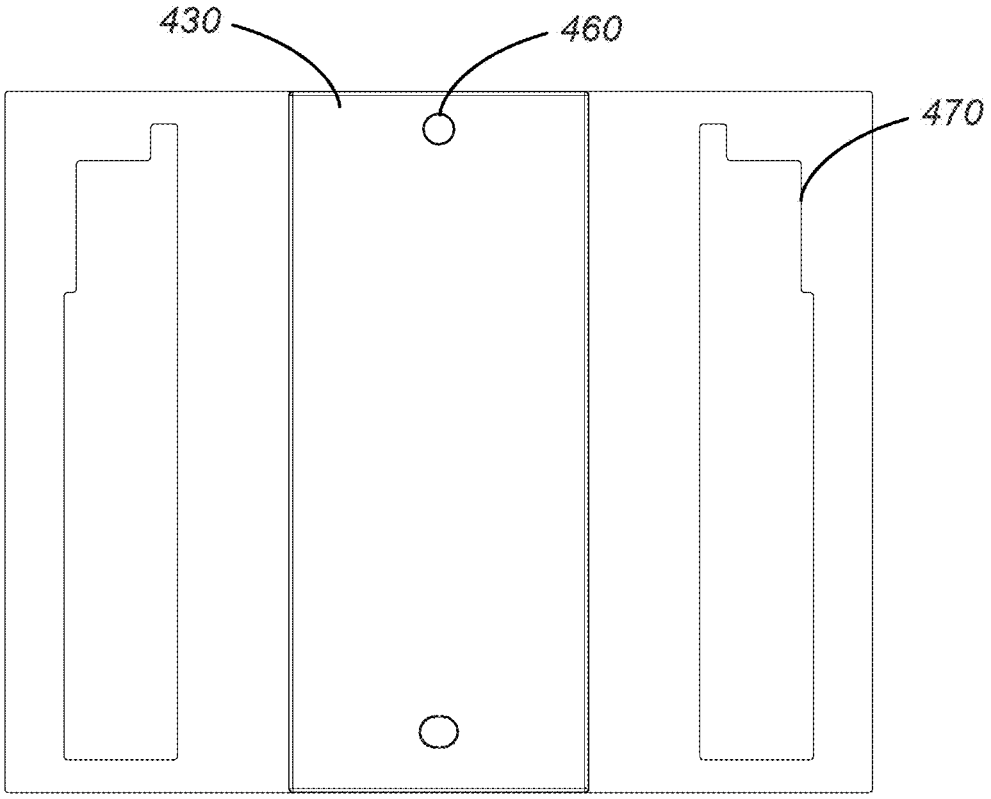
FIG. 4D shows a second elevation view of the mount.
Figure 4E:
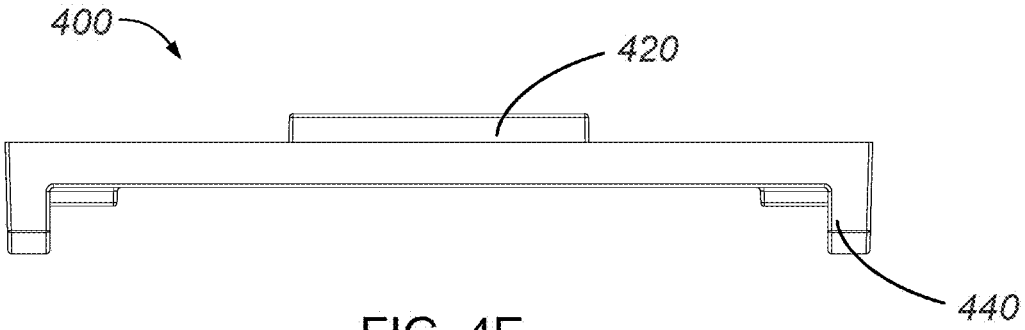
FIG. 4E shows a second plan view of the mount.
Figure 4F:
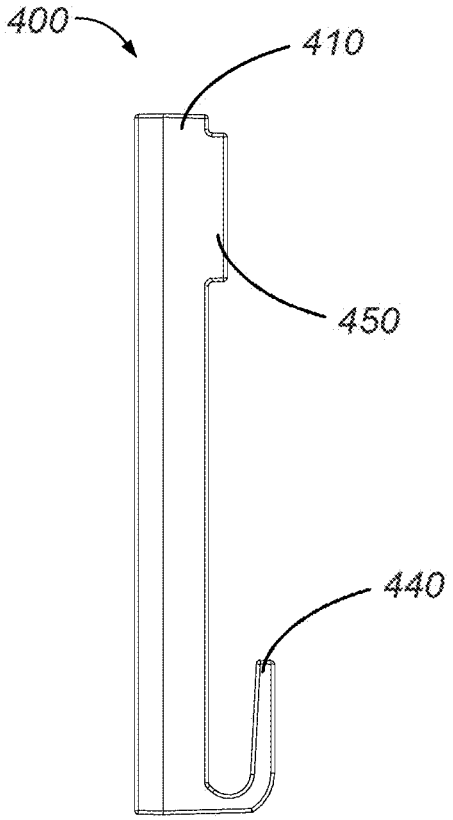
FIG. 4F shows a third elevation view of the mount.
Figure 4G:
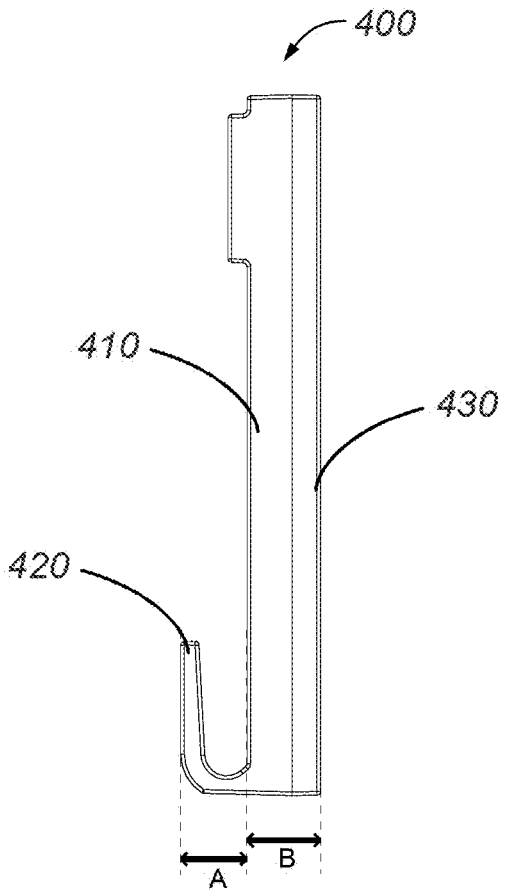
FIG. 4G shows a fourth elevation view of the mount.
Figure 5A:
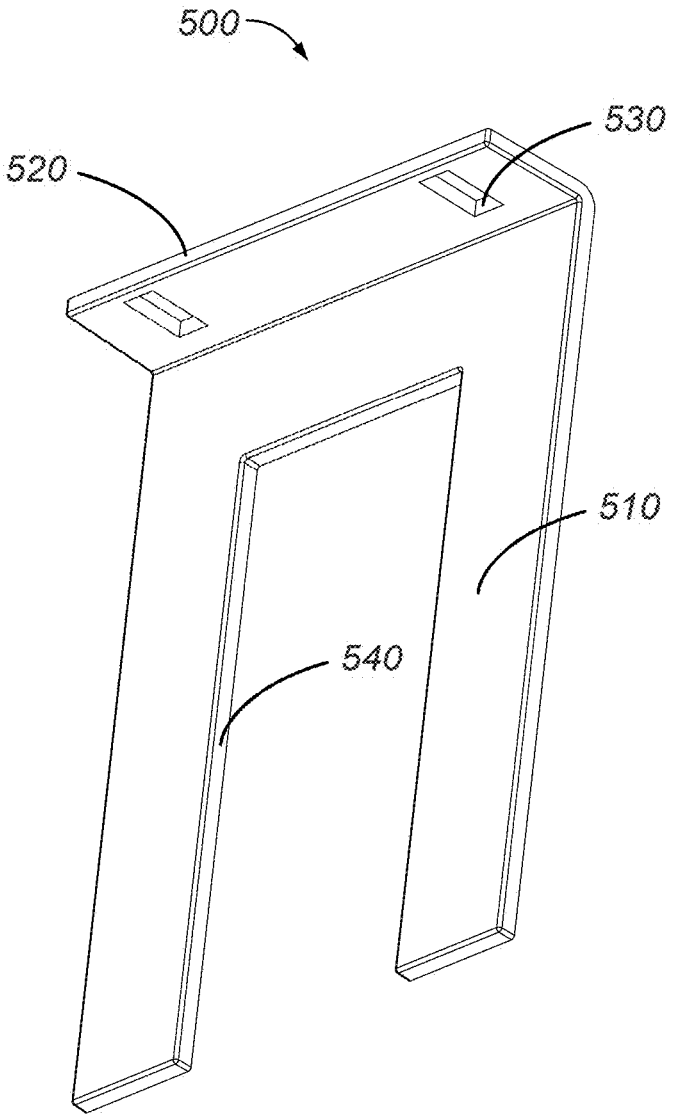
FIG. 5A shows a perspective view of an alignment guide for use in the system of FIG. 1A.
Figure 5B:
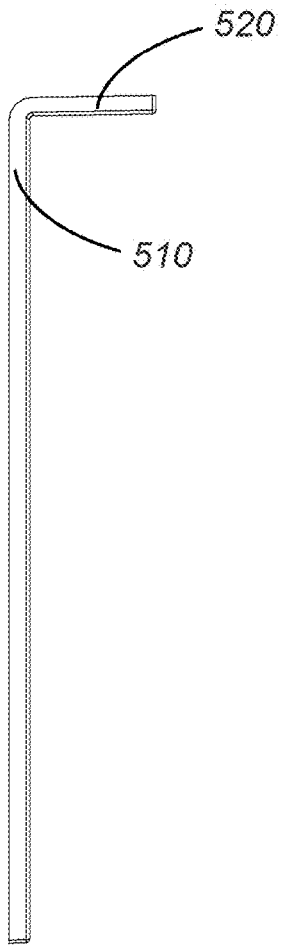
FIG. 5B shows a first elevation view of the alignment guide of FIG. 5A.
Figure 5C:
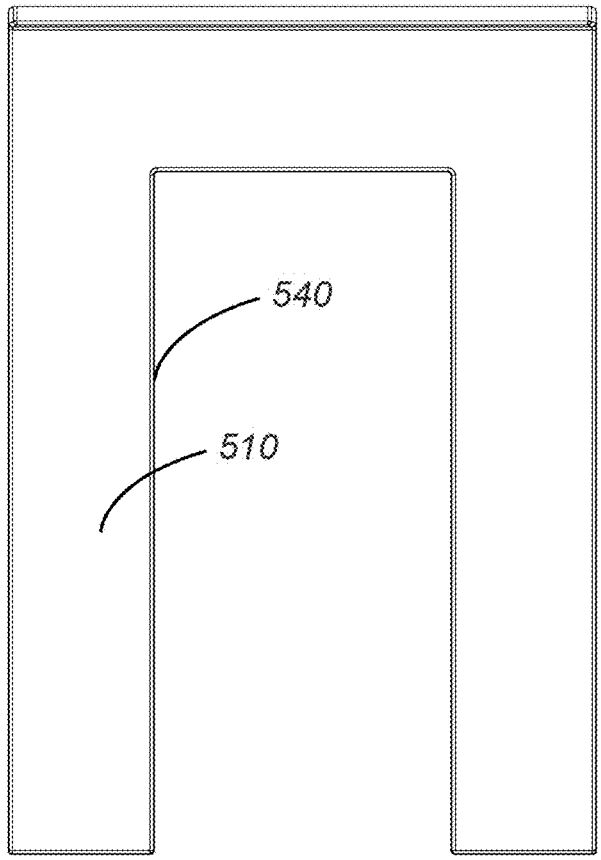
FIG. 5C shows a second elevation view of the alignment guide.
Figure 5D:
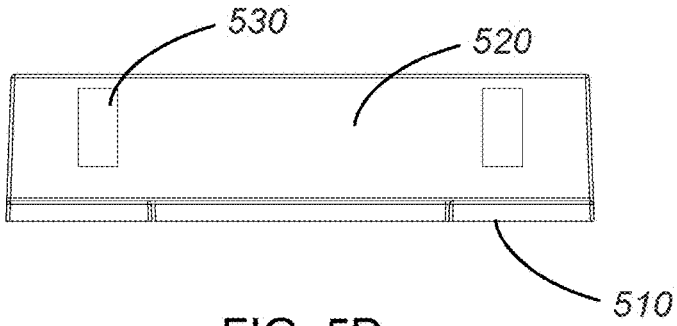
FIG. 5D shows a plan view of the alignment guide.

FIGS. 4A-4G show various views of the mount 400. The mount 400 includes a mounting base 410, a plate receiving portion 420 which can also be referred to as a cutout, an alignment portion 430, hook holders 440, protrusions 450, apertures 460, and weight reduction portions 470. FIG. 4A shows a perspective view of the mount 400. FIG. 4B shows a first plan view of the mount 400 and may be termed a top view. FIG. 4C shows a first elevation view of the mount 400 and may be termed a front view. FIG. 4D shows a second elevation view of the mount 400 and may be termed a back view. FIG. 4E shows a second plan view of the mount 400, and may be termed a bottom view. FIGS. 4F-4G show a third and a fourth elevation view respectively and may be termed a left and a right view.

The mounting base 410 of the mount 400 may have the plate receiving portion 420 positioned substantially centered on the mounting base 410 and may include a carved-out portion configured to house and/or hold the plate 300. As such, although the plate receiving portion 420 is substantially rectangular in the figures, if the plate 300 was circular in shape then the plate receiving portion 420 would similarly be circular in shape so as to receive the plate 300 and hold it in place. The alignment portion 430 is positioned on the mounting base 410 opposite the receiving portion 420. The alignment portion 430 may be substantially rectangular in shape so as to easily interface with the alignment guide 500 as will be explained herein.

The hook holders 440 may be positioned at opposite ends of the mount 400. The hook holders 440 may be substantially L-shaped or J-shaped when viewed from the perspective of FIGS. 4F-4G. The hook holders 440 are configured to retain the basketball hoop 600 while allowing for maneuverability of the basketball hoop 600 as will be described herein. The hook holders 440 may extend outwardly from the mounting base 410 so as to be separate from the mounting base 410 and allow for insertion of the basketball hoop 600. A distal portion of the hook holders 440 may be limited in distance extending orthogonally from the mounting base 410 so as to provide a limited clearance or distance from which the mount 400 ultimately extends from the wall to which the mount 400 is attached. The hook holders 440 need not be hook-shaped and instead simply be holders that receive portions of the basketball hoop 600. By way of example and not of limitation, the hook holders 440 may simply be protrusions or protuberances that are rectangular shaped, or arc-shaped (or any shape for that matter) that include apertures extending therethrough. In such a situation, the basketball hoop 600 would need snap-in-place connections to be compressed and then inserted in between the protrusions which would then expand so as to be inserted into the apertures in the protrusions and the basketball hoop 600 would be held in place by the protrusions. This situation is similar to how many typical toilet-paper rolls are held in place in household restrooms. Two protrusions extend out of a wall to receive a compressible cylinder there-between which has a toilet-paper roll placed thereon to be held up in the air when the compressible cylinder is expanded into the protrusions that are mounted to the wall. As such, there are various configurations of the hook holders 440 which will serve to hold the basketball hoop 600 up in the air and allow for maneuverability of the basketball hoop that do not require the hook holders 440 to be hook-shaped. Moreover, the hook holders 440 need not be placed on opposite ends of the mount 400, but can be placed at more centrally located positions on the mounting base 410. However, placing the hook holders 440 at opposite ends allows for greater stability of the basketball hoop 600.

Further, the mount 400 includes the protrusions 450 located at a location slightly beneath a top of the mounting base 410. The protrusions 450 extend outward from the mounting base 410 and include right-angles to provide an additional place for framing pictures. As shown in the figures, the protrusions 460 do not extend all-the-way down sides of the mount 400 so as to allow for easier placement of the basketball hoop 600, and to reduce a distal distance of the hook holders 440 from the wall.

The mounting base 410 further includes the apertures 460 extending therethrough to align with the apertures 310 on the plate 300 in addition to aligning with the apertures 250 of the locator sleeves 240 of the placement guide 200. As such, the mount 400 will include a same number of apertures 460 as each of the plate 300 and the placement guide 200.

Further, the mount 400 includes the weight reduction portions 470. The weight reduction portions 470 assist with reducing weight of the mount 400 so as to reduce strain on the wall to which the mount may be attached. The weight reduction portions 470 may be positioned so as to not interfere with other aspects of the mount 400 described herein.

Further, note that in FIG. 4G a distance A is shorter than a distance B. This is significant for purposes of hanging a picture frame on the mount 400 which will be described herein, in which a picture within a picture frame will not be pressed against by the hook holders 440 to produce bumps in the picture because a distal end of the hook holders 440 refrain from pressing against the picture to create bumps by keeping a tight distance from the wall from which the mount 400 will hang.

FIGS. 5A-5D show the alignment guide 500. The alignment guide 500 includes an alignment base 510, a flange 520, connection points 530, and a cutout 540. The alignment guide 500 is shown in a perspective view in FIG. 5A, in a first elevation view in FIG. 5B, in a second elevation view in FIG. 5C, and in a plan view in FIG. 5D, wherein the first perspective view may be termed a left view which is a mirror-opposite of a right view of the alignment guide 500, the second elevation view may be termed a front view of the alignment guide 500, and the plan view may be termed a bottom view of the alignment guide 500.

The alignment base 510 may be substantially flat so as to interface with a flat portion of a wall. The alignment base 510 may include the flange 520 extending outwardly therefrom similar to the placement guide 200. Also similar to the placement guide 200, the alignment guide 500 may include a leveler. The leveler for the alignment guide 500 is not shown in FIGS. 5A-5D, but is shown in FIGS. 1A-1B. As such. FIGS. 5A-5D show an alternative configuration for interfacing with a leveler, wherein the alignment guide 500 shown in FIGS. 5A-5D may utilize any of the leveler configurations described with relation to the placement guide 200 above, and similarly the placement guide 200 may use the leveler configuration now described for the alignment guide 500 with relation to FIGS. 5A-5D. Given that the leveler used with the alignment guide 500 is not shown in FIGS. 5A-5D, connection points 540 for connecting to a leveler can be seen. These connection points 540 may be configured to receive a leveler or portions thereof at or through the connection points 540. For example, the leveler may include snap-fits that may extend through the connection points 540 so as to be secured to the flange 520. Alternatively, the leveler may include an adhesive or hook and loop material or screws or bolts and nuts other ways of fastening so as to attach at the connection points 540 and remain level with and attached to the flange 520.

The alignment guide 500 further includes the cutout 540. The cutout 540 is shaped to slide into place around the alignment portion 430 of the mount 400. The alignment portion 430 of the mount 400 includes substantially vertical and substantially straight sides to be fitted within the cutout 540, and when aligned within the cutout 540 the alignment guide 500 can assist with keeping the mount 400 vertical when installing the mount onto a wall by utilizing the leveler that may attach to the flange 520.

Figure 6A:
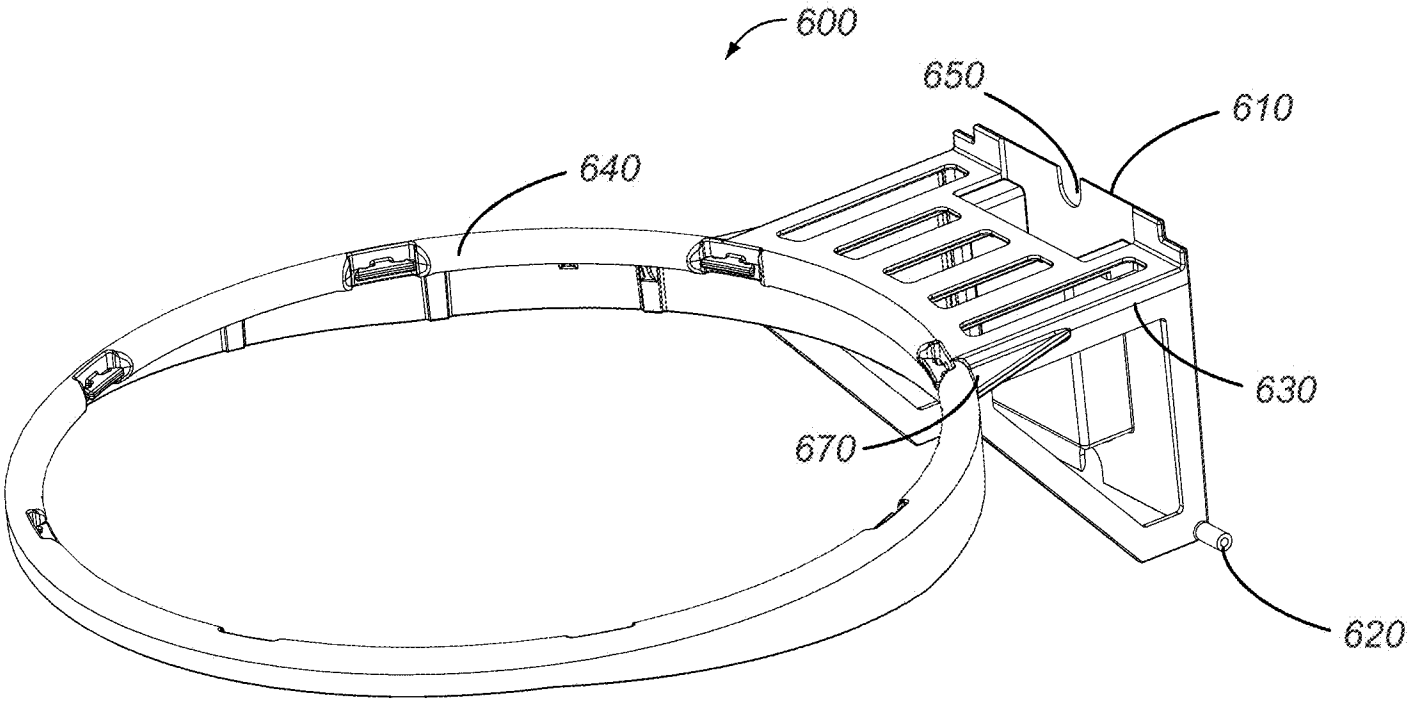
FIG. 6A shows a first perspective view of a basketball hoop for use in the system of FIG. 1A.
Figure 6B:
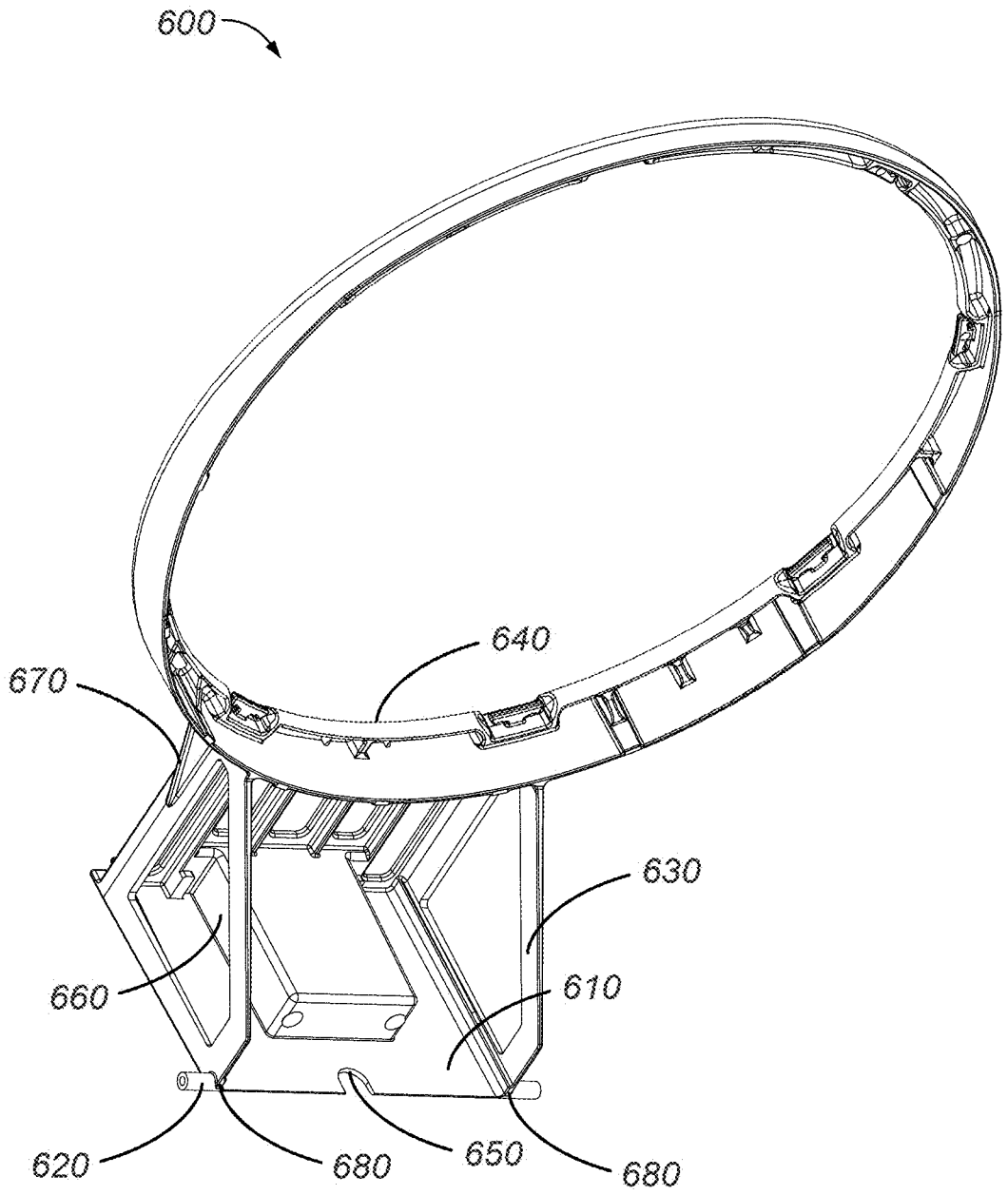
FIG. 6B shows a second perspective view of the basketball hoop of FIG. 6A.
Figure 6C:
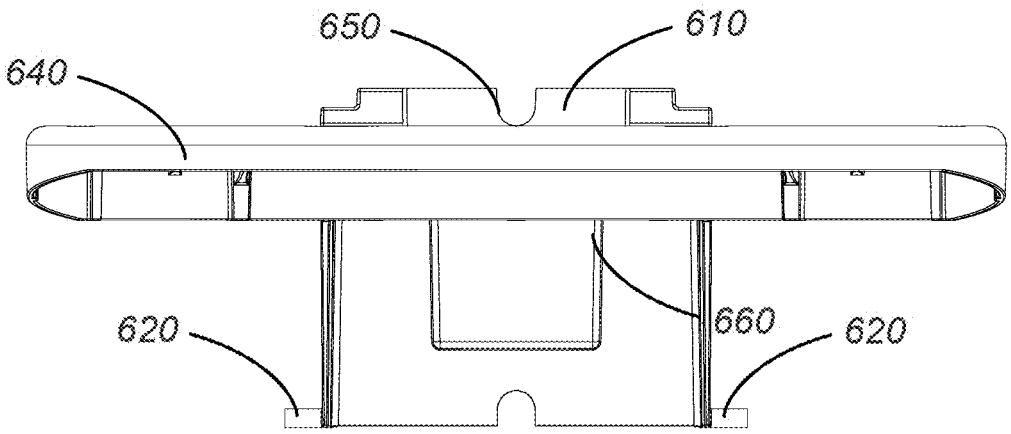
FIG. 6C shows a first elevation view of the basketball hoop.
Figure 6D:
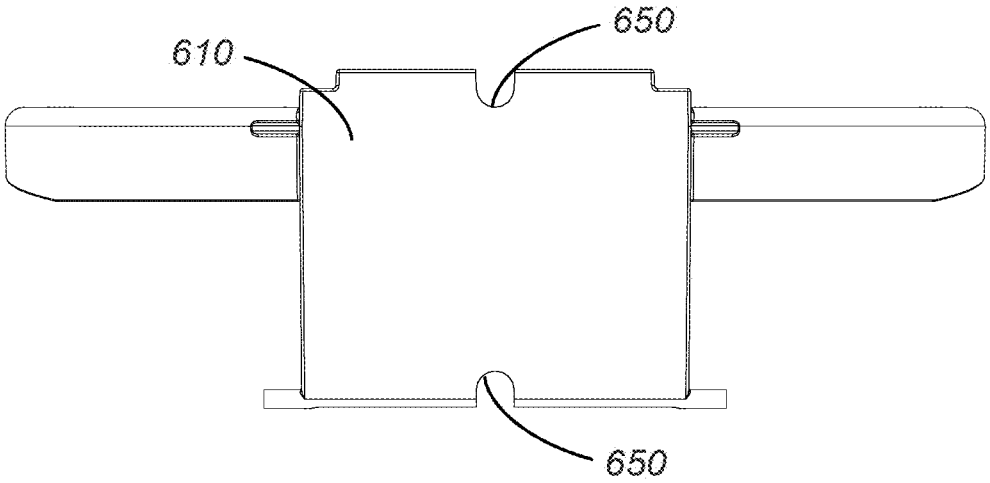
FIG. 6D shows a second elevation view of the basketball hoop.
Figure 6E:
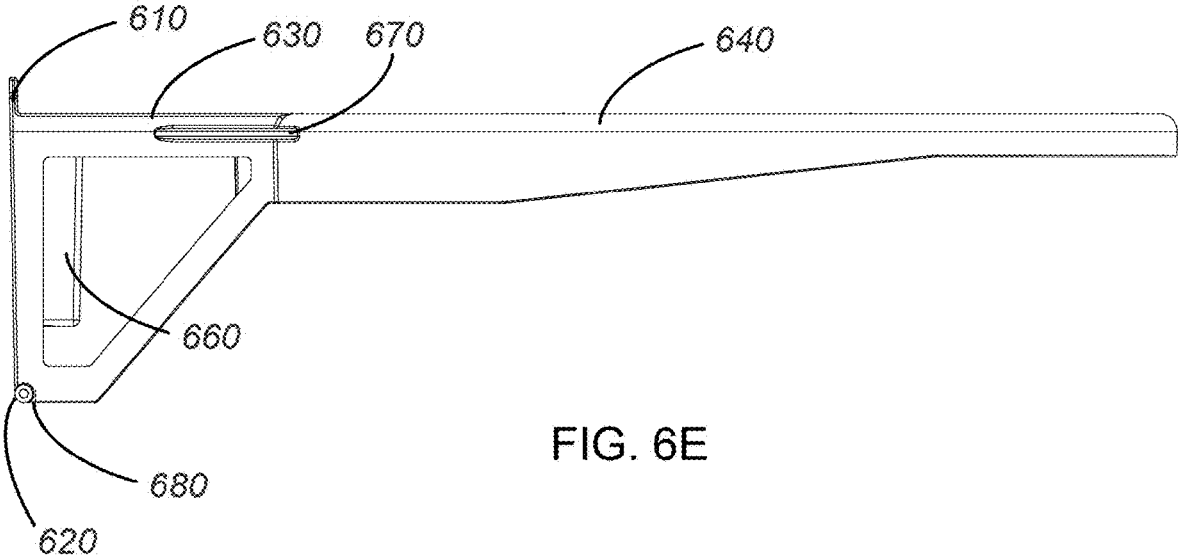
FIG. 6E shows a third elevation view of the basketball hoop.
Figure 6F:
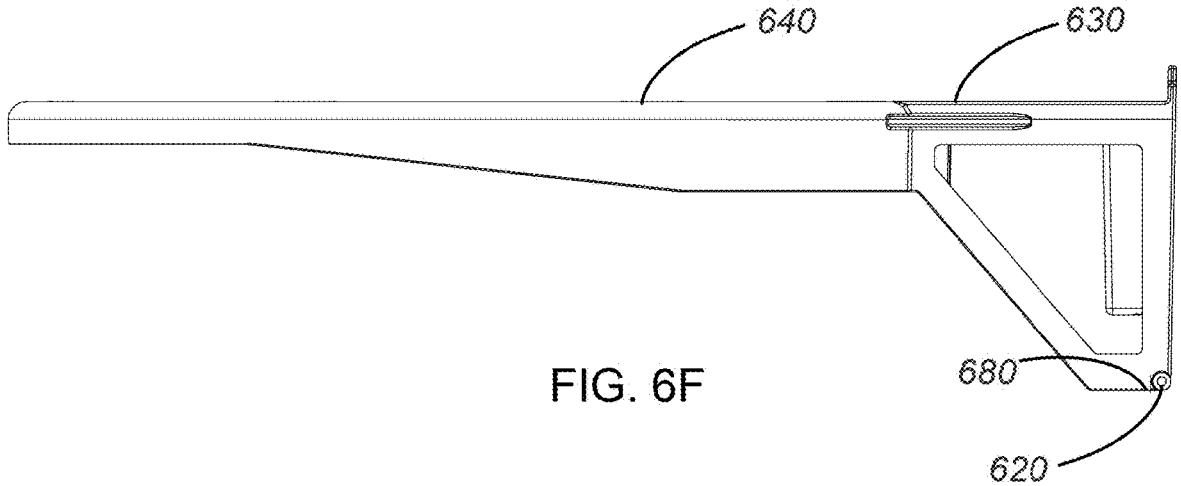
FIG. 6F shows a fourth elevation view of the basketball hoop.
Figure 6G:
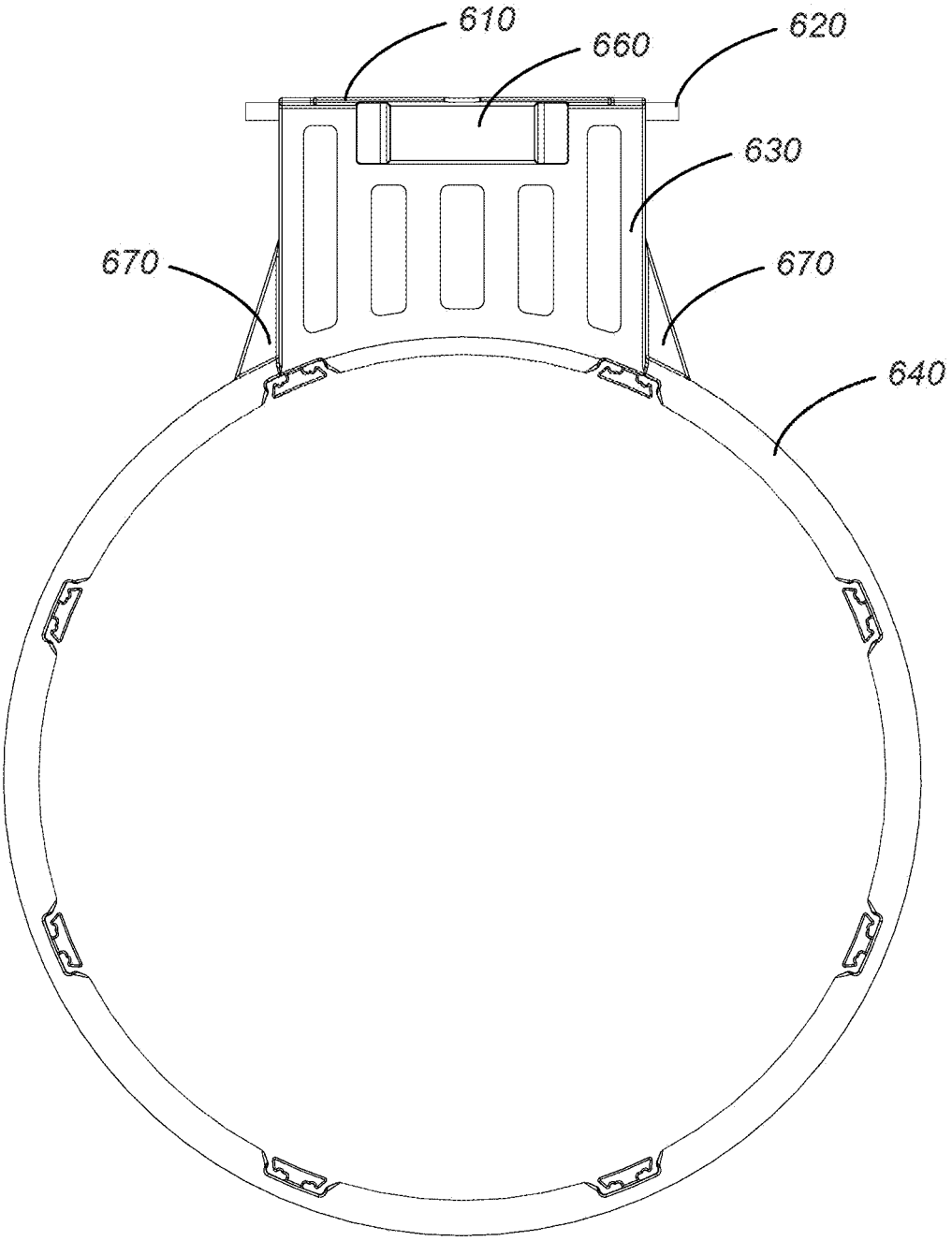
FIG. 6G shows a first plan view of the basketball hoop.
Figure 6H:
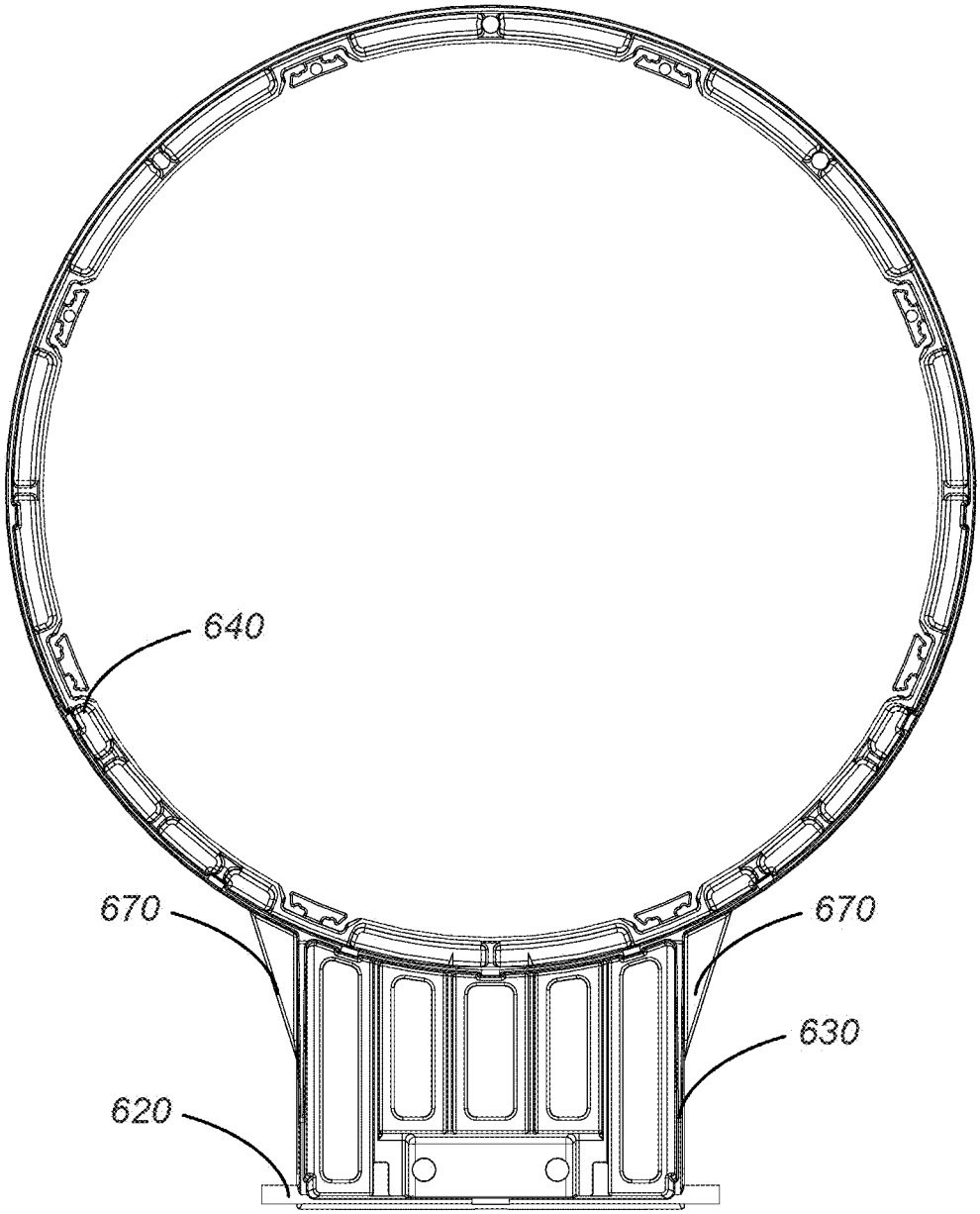
FIG. 6H shows a second plan view of the basketball hoop.

FIGS. 6A-6H show various views of the basketball hoop 600. The basketball hoop 600 includes a base portion 610, cylindrical protrusions 620, a frame 630, a rim 640, cutouts 650, a magnet housing 660, a bridge 670, and a flat bracket 680. FIGS. 6A-6B show alternative perspective views of the basketball hoop 600. FIGS. 6C-6F show a first elevation view: a second elevation view, a third elevation view, and a fourth elevation view respectively of the basketball hoop 600. FIGS. 6G-6H show a first and a second plan view respectively of the basketball hoop 600. The first elevation view may be termed a front view of the basketball hoop 600, the second elevation view may be termed a back view, the third elevation view may be termed a left-side view, the fourth elevation view may be termed a right-side view: the first plan view may be termed a top view, and the second plan view may be termed a bottom view:

The base portion 610 of the basketball hoop 600 is preferably flat so as to interface smoothly with the plate 300. The base portion 610 includes cylindrical protrusions 620 extending therefrom in a parallel direction to be inserted in an area formed by the hook holders 440 of the mount 400. As such, the cylindrical protrusions 620 being housed within the hook holders 440 will allow for rotation of the basketball hoop 600 about an axis formed along the cylindrical protrusions 620 within the hook holders 440. As will be described in conjunction with FIGS. 12-15, the cylindrical protrusions 620 can rotate at least and approximately ninety degrees within the hook holders 440. The frame 630 of the basketball hoop 600 may extend perpendicularly from the base portion 610 and provide a "stop" for the hook holders 440 to be placed against so as to remove translational motion of the basketball hoop in a direction along the axis formed by the cylindrical protrusions 620 within the hook holders 440.

The frame 630 of the basketball hoop 600 may further include weight reduction portions the same as the mount 400 in which removing material from the basketball hoop 600 will reduce weight constraints on the wall to which the basketball hoop 600 will be used on. As shown in the figures, the frame 630 may include these weight reduction portions by comprising a framing structure rather than continuous material from portion-to-portion of the basketball hoop 600. Examples include the diagonal portion of the frame 630 extending from the cylindrical protrusions 620 to the rim 640 with a vertical portion extending along the base portion 610 and a horizontal portion extending outward from the base portion 610 to the rim 640 so as to form a roughly triangular portion cut-out therebetween on each side of the frame 630. Further examples include weight reduction portions that are roughly rectangular on the frame 630 that can be seen from the first plan view in FIG. 6G.

The basketball hoop 600 further includes the rim 640 extending from the frame 630 so as to provide a portion of the basketball hoop 600 capable of receiving a ball for play and a net to hang therefrom.

The basketball hoop 600 further includes the cutouts 650 on the base portion 610 which assist the basketball hoop 600 from interfering with the fasteners 150 when the basketball hoop 600 rotates.

The basketball hoop 600 further includes the magnet housing 660. The magnet housing 660 is configured to house magnets that will extend magnetic fields through the base portion 610 and connect to the plate 300. Note that the mount 400 can also be magnetic and need not include the plate 300 such that the base portion of the basketball hoop 600 sticks to the mount 400 with the magnet positioned within the magnet housing 660. This simultaneously provides the ability of the basketball hoop 600 to remain upright and extend orthogonally from a wall to which the basketball hoop is attached, while also allowing for the basketball hoop 600 to disengage and fall limp so as to dangle by the cylindrical protrusions 620 from the hook holders 440 on the mount 400. The magnet housing 660 may be any suitable shape to house the magnets, and may be configured to receive the cap 700 shown in FIGS. 7A-7E for easy removal of the magnets. Alternatively, a cap may exist directly on the frame 630 which may be openable and closeable to as to insert and remove magnets. Alternatively, magnets may be permanently placed within the magnet housing 660 without an easy means of access so as to prevent users from removing and/or accessing the magnets.

The basketball hoop 600 further includes one or more bridges 670. The bridges 670 connect an outside of the frame 630 to the rim 640. In this regard, rather than the frame 630 only being directly attached to the hoop 640, the bridges 670 provide extra support to the rim 640 adding additional tension to the rim 640 thus reducing a likelihood of bending of the rim 640. In particular, when strain is placed on the rim 640 from a downward motion, the rim 640 can become deformed due to its only connection being where it contacts the frame 630. The bridges 670 provide additional support to reduce deformation and add strength to the basketball hoop 600.

It is to be further noted that in conjunction with the bridges 670 reducing an amount of deformation to the rim 640, it is preferable to be balance with some deformation of the rim 640 when hit with a basketball from a top of the rim 640 (the basketball coming from substantially a vertical direction) is desirable. This is because if the rim 640 deforms slightly downward when hit with the basketball the rim 640 will snap back into a horizontal position thus slinging the basketball back into the air much like a spring. When playing basketball, this can add to an enjoyment of the game with the ball bouncing higher when bouncing off the rim. Thus, when including the bridges 670 on the hoop 600 so as to strengthen the rim 640, it is preferable to not extend the bridges 670 too far out on the rim 640 so as to reduce all deformation of the rim 640 when a downward force is placed thereon. Given by example and not of limitation, this may mean keeping ends of the bridges 670 from extending more than two or three inches laterally outward on the rim 640. This is to be balanced with the fact that the hoop 600 is meant to drop (rotate downward) when too much force is placed on the rim 640 such that the magnets within the magnet housing 660 disconnect from the steel plate 300 and the hoop 600 begins downward rotation about an axis defined by the cylindrical protrusions 620 within the hook holders 440. Thus, the bridges 670 can extend further out on the rim 640 (more than three inches out) while still allowing for deformation if the hoop 600 were permanently affixed to the wall, but this amount of force instead would cause the magnets to detach from the steel plate 300 before the rim 640 could deform. Given by way of example and not of limitation, a preferred weight or force applied downwardly to an end of the rim 640 may be 20-lbs at which point the magnets would detach from the steel plate 300 and prevent greater amounts of strain being placed on a connection between the mount 400 and the wall to which it is attached (which happens for example on a regular prior art basketball hoop when a user dunks the basketball therein).

The basketball hoop 600 further includes the flat bracket 680 as part of the frame 630. A purpose of having the flat brackets 680 is more fully understood when viewed with FIGS. 12-15 which will be discussed herein. Rather than having the frame 630 immediately extend outward at an angle from the cylindrical protrusions 620 at the base portion 610, the flat brackets 680 extend a direction substantially parallel to a direction in which the rim 640 extends from a base of the cylindrical protrusions 620. Thus, when the hoop 600 interfaces with the mount 400, the flat brackets 680 will extend a direction substantially perpendicular from the mount 400 when the hoop 600 is in a use position, and will interface parallel with the mounting base 410 when the hoop 600 is rotated to a non-use position.

Figure 7A:
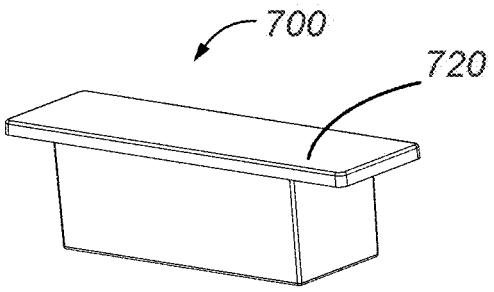
FIG. 7A shows a first perspective view of a cap for use in the system of FIG. 1A.
Figure 7B:
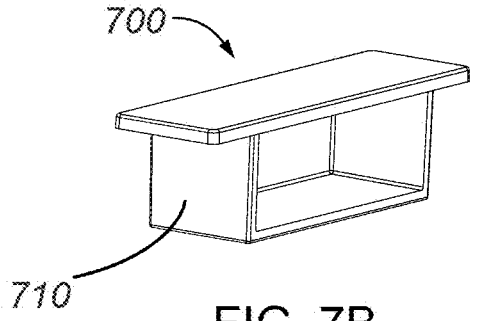
FIG. 7B shows a second perspective view of the cap for FIG. 7A.
Figure 7C:
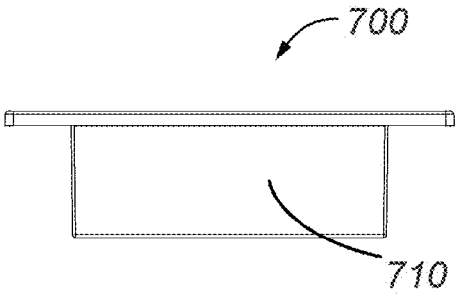
FIG. 7C shows a first elevation view of the cap.
Figure 7D:
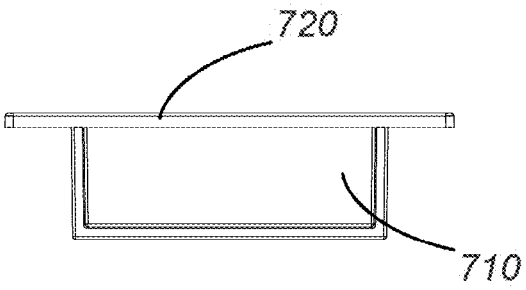
FIG. 7D shows a second elevation view of the cap.
Figure 7E:
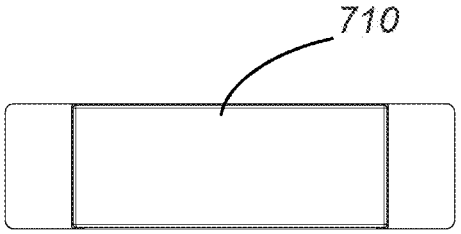
FIG. 7E shows a plan view of the cap.

FIGS. 7A-7E show various views of the cap 700. The cap 700 includes a fit portion 710 and a top 720. Alternate perspective views of the cap 700 are shown in FIGS. 7A-7B. A first elevation view and a second elevation view are shown in FIGS. 7C-7D respectively, and a plan view is shown in FIG. 7E, wherein the first elevation view may be termed a front view; the second elevation view may be termed a back view, and the plan view may be termed a bottom view.

The fit portion 710 is shaped to slidingly engage within the magnet housing 660 of the basketball hoop 600, wherein the fir portion will accommodate whatever shape the magnet housing 660 may be. In the figures, this is substantially a rectangular shape. Further, the fit portion 710 of the cap 700 may be hollow as can be seen in FIGS. 7B and 7D so as to assist with weight reduction of the system. The top 720 may extend across a hole of the magnet housing 660 without being capable of fitting within the magnet housing 660.

Figure 8:
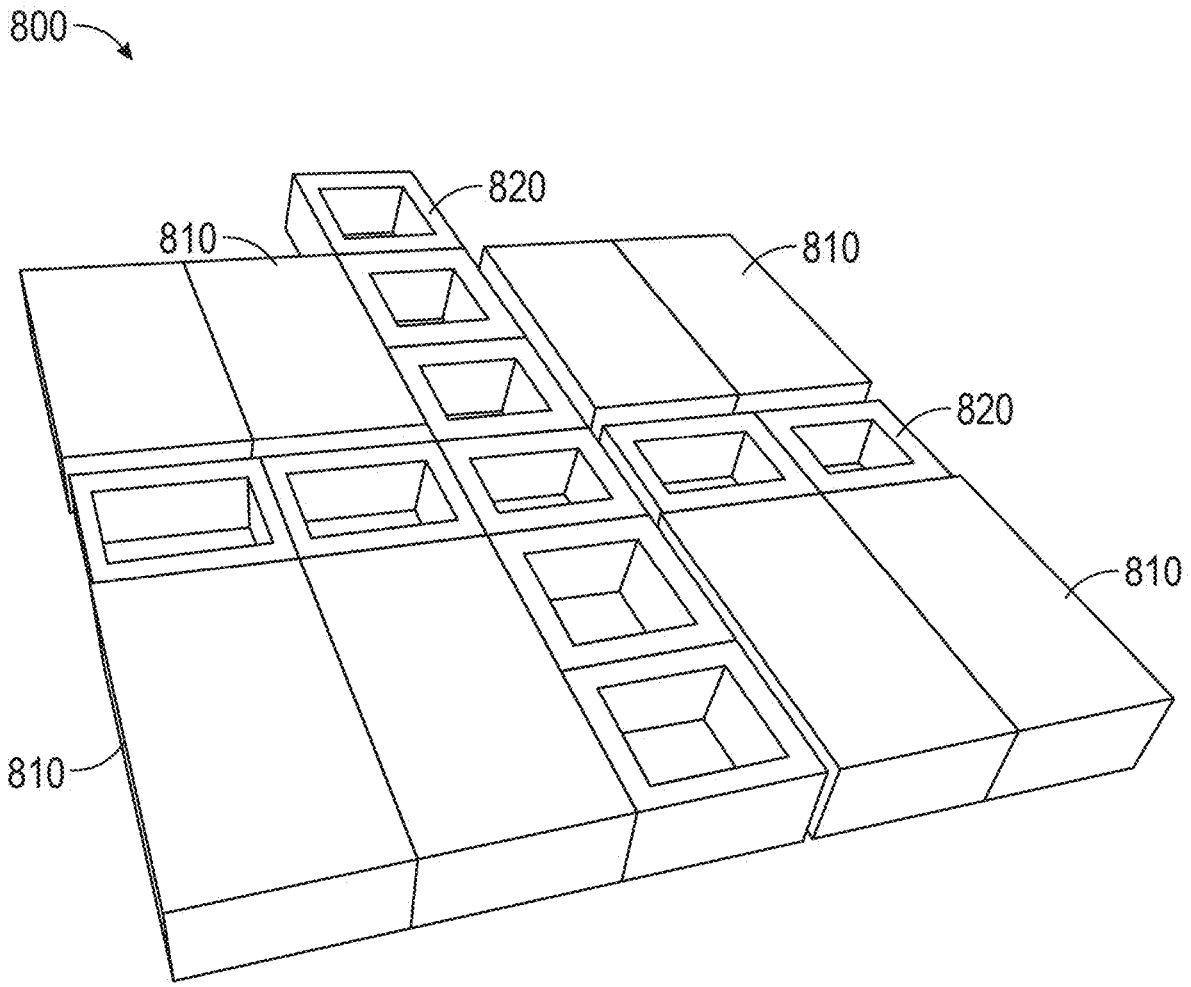
FIG. 8 shows a perspective view of a plurality of magnets for use in the system of FIG. 1A.

FIG. 8 shows an example configuration of the magnet 800. As shown, the magnet 800 may comprise a plurality of magnets 810, and a frame 820. In the configuration shown, the plurality of magnets 810 may be spaced apart so as to not create an overly powerful magnetic field centralized in one spot, but rather spread the magnetic fields across a distance still contained within constraints of a height and width of the plate 300. The magnet 800 may comprise rare earth magnets for extra strength. The magnet 800 may comprise N52 type magnets which are known for having a high strength-to-size ratio.

Figure 9A:
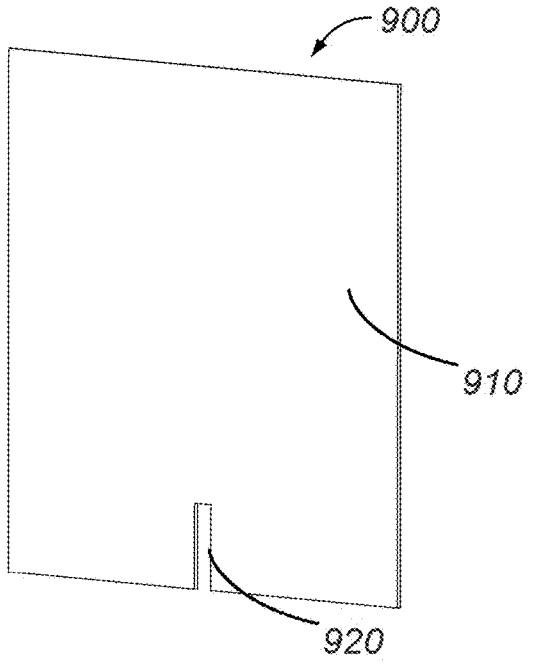
FIG. 9A shows a perspective view of an interchangeable backboard.
Figure 9B:
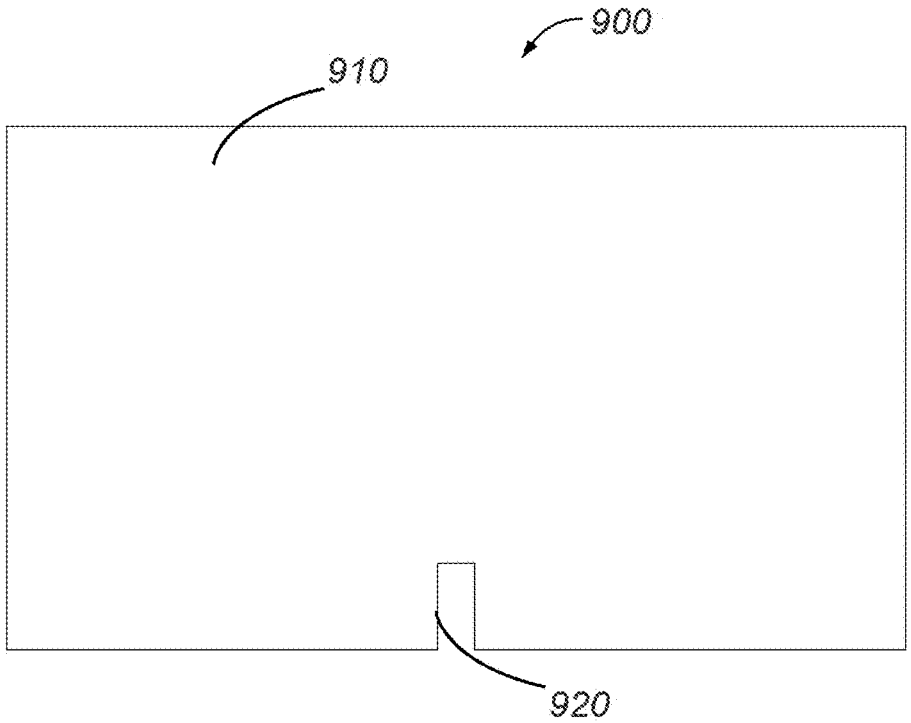
FIG. 9B shows an elevation front view of the interchangeable backboard of FIG. 9A.
Figure 9C:
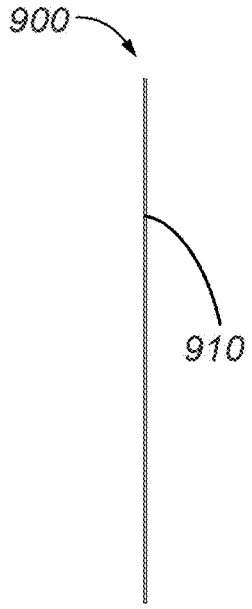
FIG. 9C shows an elevation side view of the interchangeable backboard of FIG. 9A.
Figure 10:
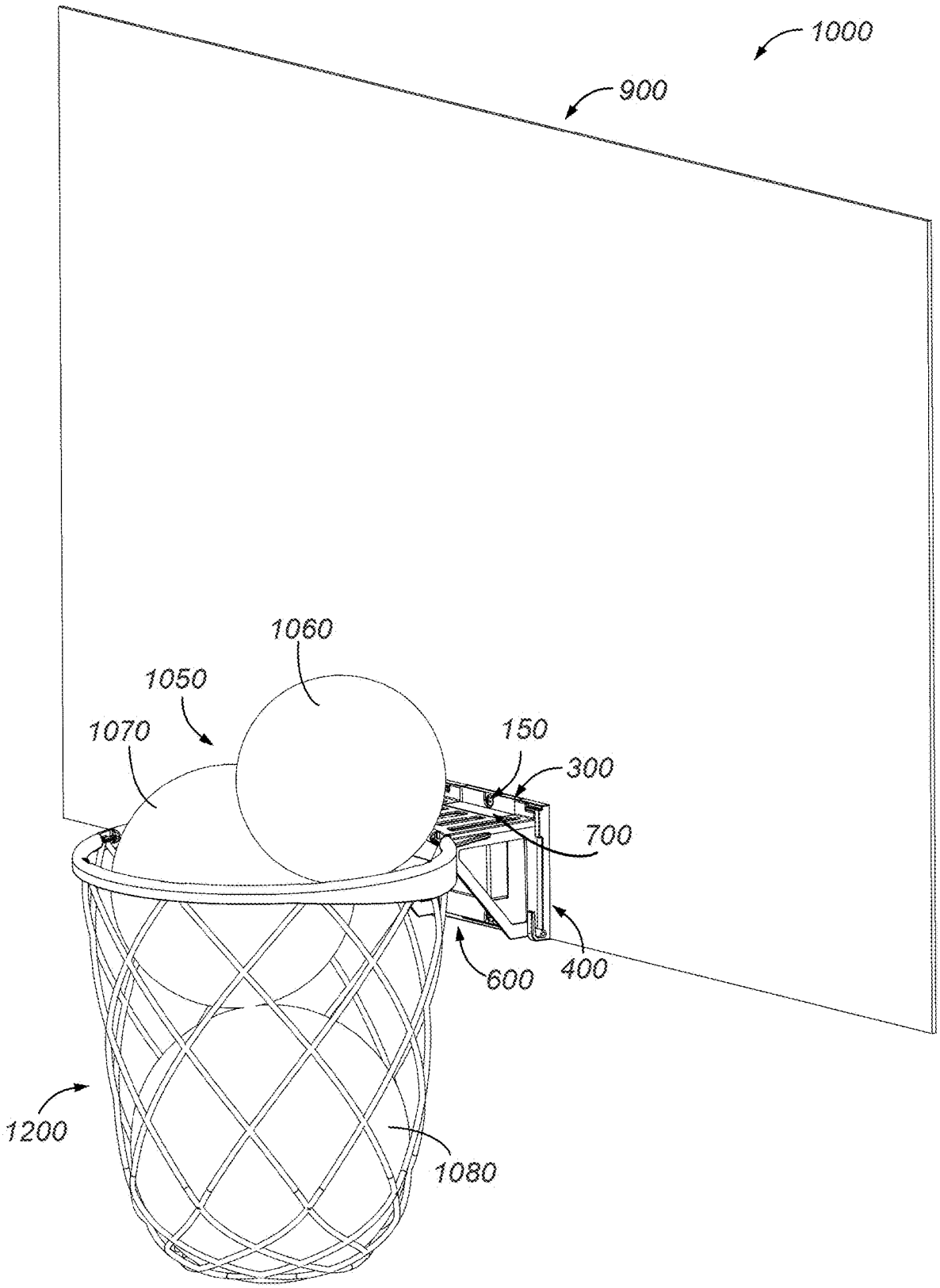
FIG. 10 shows a perspective view of a basketball hoop system.

FIGS. 9A-9C show an interchangeable backboard 900 according to some aspects of the present disclosure. The interchangeable backboard 900 includes a base backboard 910 and a cutout 920. The cutout 920 extends into the base backboard 910 and is configured to slidingly engage the alignment portion 430 of the mount 400. In this regard, the interchangeable backboard 900 may be positioned on and affixed to the mount 400 as shown in FIG. 10. The base backboard 910 is configured so as to substantially be a width (depth) of a distance between the mounting base 410 and the wall to which the mount 400 is attached. This distance is created because of the alignment portion 430 extending from the mounting base 410 and being in direct contact with the wall to which the mount 400 is attached. In this regard, when the mount 400 is attached to the wall via the fasteners 150, the alignment guide 430 will be in contact with the wall, and the mounting base 410 will be a short distance from the wall, and the interchangeable backboard 900 can be slid in between this short distance (between the mounting base 410 and the wall) and the cutout 920 will engage with the alignment portion 430. It is to be understood that the interaction between the cutout 920 and the alignment portion 430 need not be rectangular in shape but could include curves, be stadium shaped, be triangular shaped, be rhombus shaped, etc. Furthermore, the cutout 920 need not be centered on the backboard 900 although preferably it is. In this regard, when the interchangeable backboard 900 is positioned therein, the mount 400 will hold the backboard 900 against the wall, and the interchangeable backboard 900 can easily be pulled loose by applying an upward force to the interchangeable backboard 900.

It is further understood that one of the purposes of the interchangeable backboard is to allow for different images to be placed thereon for ease in swapping out and customizing the basketball hoop experience. Given by way of example, the interchangeable backboard 900 may have a first image on a first side and a second image on a second side for easy removal, rotation, and insertion of the interchangeable backboard 900 to a position behind the mount 400 for a different experience for users of the basketball hoop 600. This may include differing images such as the first image being one of Cailtin Clark and the second image being one of a massive University of Iowa logo on the different sides of the interchangeable backboard 900, or alternatively the interchangeable backboard 900 may include different geometries and images thereon for different gameplay such as the typical rectangle or square centered above the rim and different images on the second side such as various size circles at random positions on the backboard which would count for different points if hit with the basketball before falling into the hoop. Furthermore, there may include a plurality of different interchangeable backboards 900 such that there are different images on each of the plurality of different interchangeable backboards 900.

The ease of inserting and removing the interchangeable backboard 900 as described herein removes any need for tape or nails for the backboard while further allowing for customizability which is a highly desirable trait among contemporary user products, thus providing a cleaner, simpler, and customizable experience.

FIG. 10 shows a basketball hoop system 1000 assembled together and mounted to a wall. The basketball hoop system 1000 includes the fasteners 150, the steel plate 300, the mount 400, the basketball hoop 600, the cap 700, the magnets 800 (not shown as they are inside the magnet housing 660 of the basketball hoop 600), the interchangeable backboard 900, basketballs 1050, a snap clasp 1100, and a net 1200. Furthermore, the basketballs 1050 may comprise three separate basketballs 1050, a first ball 1060, a second ball 1070, and a third ball 1080 each being larger in diameter than the previous ball mentioned. This variability in ball size contributes to different experiences in play while allowing for different game-styles to play basketball in conjunction with the basketball hoop system 1000. Certain games can be played with one and/or a combination of the balls 1050.

The system 1000 is what would typically be seen when in use to play basketball. The system 1000 in some situations is an end result of what the present disclosure provides, namely a basketball playing experience with interchangeable backboards 900, a collapsible hoop 600 that reduces aggressive play in indoor environments while still providing enough stability to play seriously thus reducing damage to walls to which the hoop 600 is mounted to, and a removable hoop/rim (in which the backboard is also removeable) leaving behind the mount 400 to which pictures, frames, etc. can be hung from the wall while hiding the mount 400 and associated components remaining thereon. Furthermore, when the mount 400 is left on the wall without the hoop 600 or the interchangeable backboard 900, the mount 400 is useful in that it is a capable-of-being-permanent fixture that is substantially, if not perfectly, level (which also contributes to the hoop 600 and interchangeable backboard 900 being level when in use).

Figure 11A:
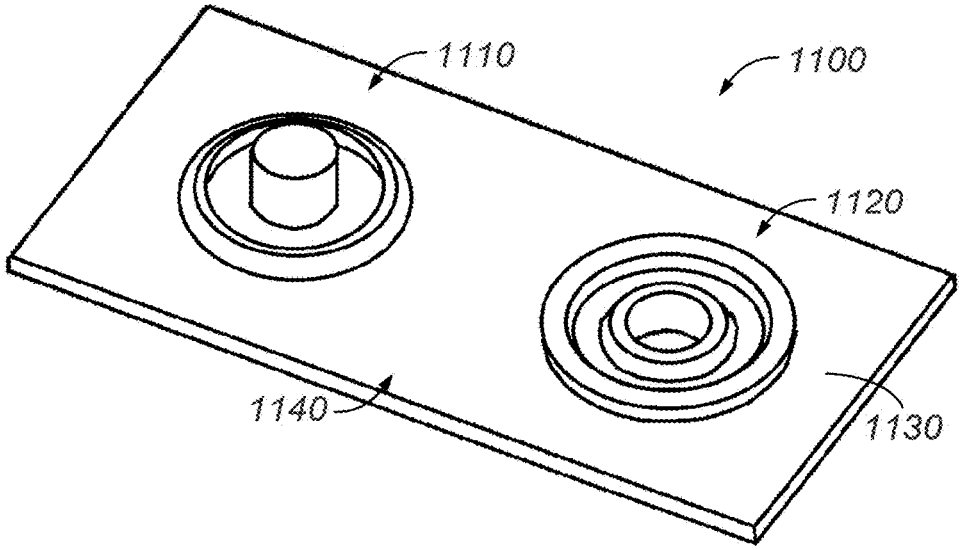
FIG. 11A shows a perspective view of a snap clasp.
Figure 11B:
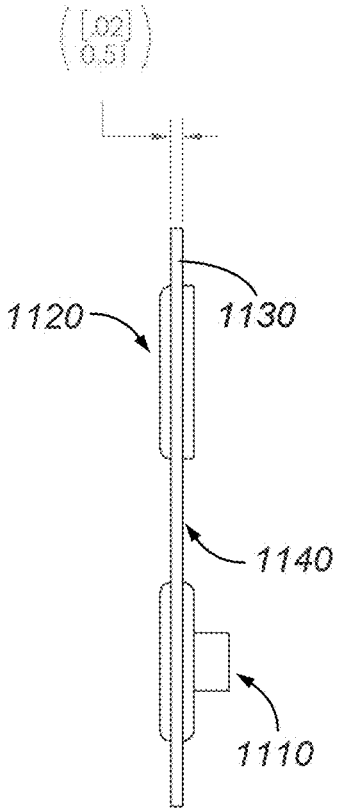
FIG. 11B shows a side elevation view of the snap clasp of FIG. 11A.
Figure 11C:
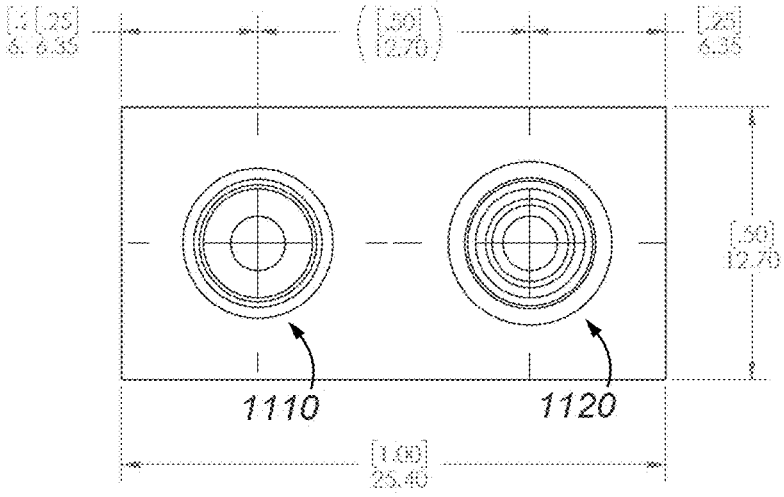
FIG. 11C shows a top plan view of the snap clasp of FIG. 11A.
Figure 12:
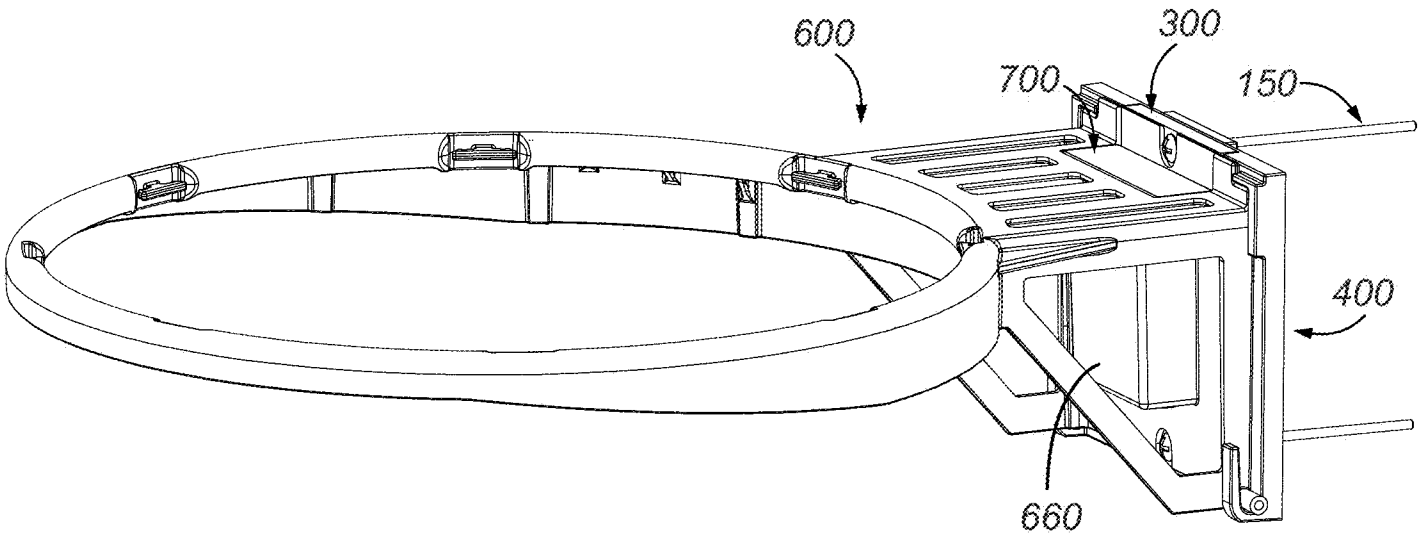
FIG. 12 shows a perspective view of a use position of the basketball hoop of FIG. 6A and mount of FIG. 4A.
Figure 13:
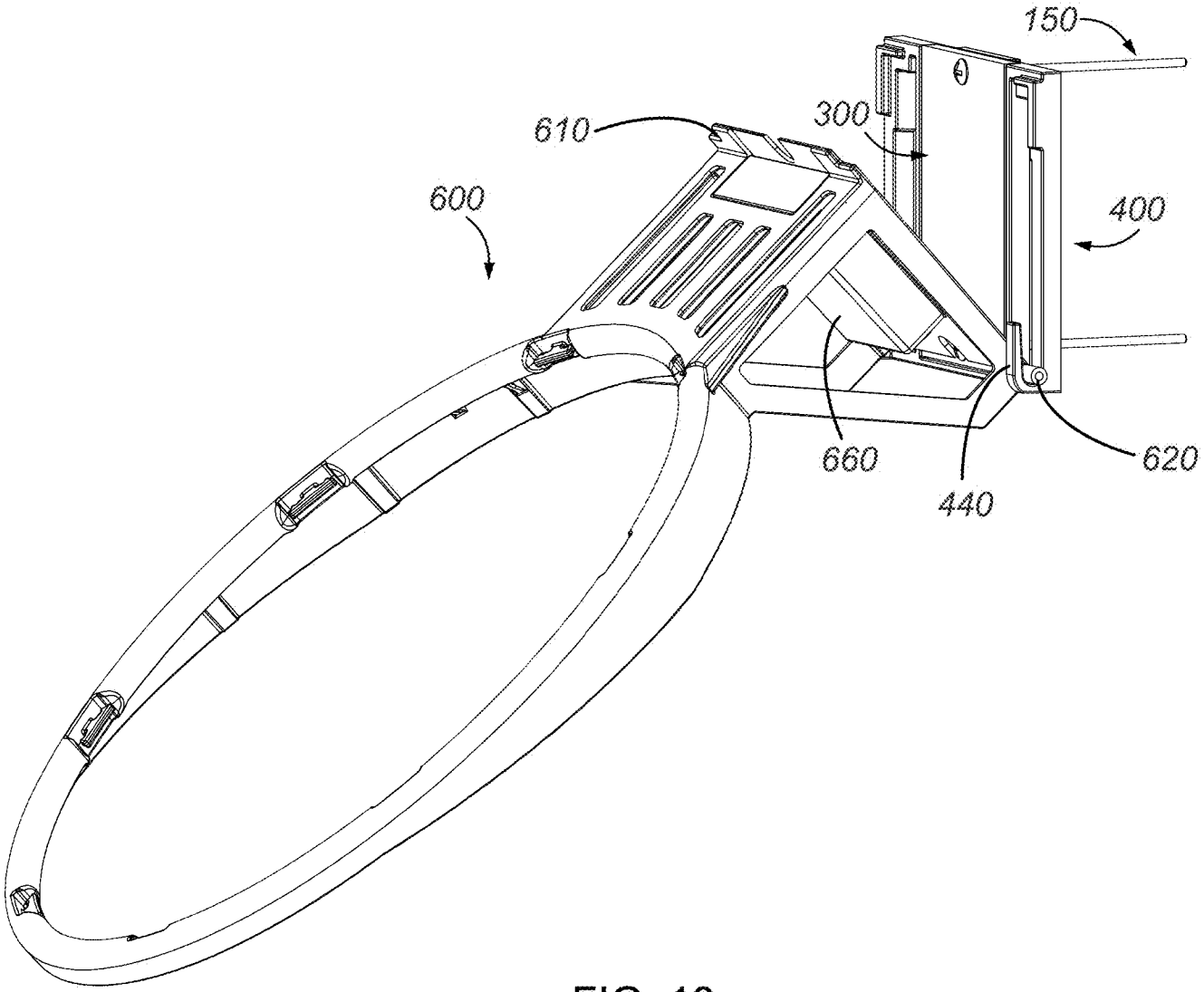
FIG. 13 shows a perspective view of a partially rotated hoop of FIG. 6A with respect to the mount of FIG. 4A.

FIGS. 11A-11C show varying views of a snap clasp 1100. The snap clasp 1100 may include a male snap 1110, a female snap 1120, a foundation 1130, and a folding line 1140 (not visible). The male snap 1110 and the female snap 1120 may exist on the foundation 1130 on opposite sides of the folding line 1140. When the system 1000 is not in use and it is desired that the balls 1050 may be stored in a convenient place, the snap clasp 1100 may be inserted through a bottom of the net 1200 at a first side of the bottom of the net and a second side of the bottom of the net may be pulled towards the first side of the bottom of the net such that the snap clasp 1100 may also be inserted through the second side of the bottom of the net. Once the snap clasp 1100 has been inserted through the first side of the bottom of the net and the second side of the bottom of the net, the snap clasp 1100 may be folded along the folding line 1140 such that the male snap 1110 and the female snap 1120 operatively interface with one another, closing the snap clasp 1100 and holding the bottom of the net securely closed so as to allow for storage of the balls 1050 in the net 1200. A plurality of the snap clasps 1100 may be used if desired to further close a gap at the bottom of the net.

These components may be combined into a kit. Furthermore, within the kit may be included other components described herein such as the placement guide 200 and the alignment guide 500 which although they are not components that remain on the wall for the basketball experience during basketball play, each of the placement guide 200 and the alignment guide 500 contribute to making the mount 400 substantially if not perfectly level when installing the mount 400, and then are removed from use. The system 1000 may further include within the kit the leveler 230 for both the placement guide 200 and the alignment guide 500 such that it is attachable to and removable from both of the placement guide 200 and the alignment guide 500 when one or the other is in use during installation. Furthermore, the kit may include a stud finder to find studs for attaching to depending on the type of fasteners 150 included within the kit or specifically to find studs to avoid attaching to depending on the type of fasteners 150 included within the kit.

To use the mounting system 100, fastener points defining a vertical line will be placed on a door, wall, or other upstanding structure, by utilizing the placement guide 200. The placement guide 200 will be placed flat against the upstanding structure on a portion known to be sturdy. The user will then ensure verticality of the fastener points by viewing the leveler 230 of the placement guide 200 and tilting the placement guide 200 until a bubble within the leveler 230 is centered, at which point the user will then insert a marking agent into each of the locator sleeves 240 so as to position the fastener points (colored spots, holes, adhesives, hook and loop material, etc.) in a manner that will be substantially vertical for the mount 400 to hang from. As such, this process could be described as locating a sturdy portion of an upstanding surface for hanging materials, placing the placement guide 200 on the sturdy portion, leveling the placement guide 200 using the leveler 230, and marking fastener points on the sturdy portion by inserting a marking agent through locator sleeves disposed on the placement guide with apertures extending therethrough.

After the fastener points have been established, the placement guide 200 will be removed and the alignment guide 500 will be placed on the sturdy portion of the upstanding surface. The alignment guide 500 will then be leveled by using a leveler positioned on top of the flange 520. In tandem with leveling the alignment guide 500, the mount 400 will be placed up against the alignment guide 500 by inserting the alignment portion 430 of the mount 400 into the cutout 540 of the alignment guide 500. Upon determining that the mount is level and that the apertures 460 are aligned with the fastener points, the fasteners 150 may be inserted through the plate 300, the mount 400, and into the fastener points on the sturdy portion of the wall or upstanding structure. The fasteners 150 may be by way of example and not of limitation, nails, screws, anchors, grommets, pins, rivets, staples, threaded inserts, adhesives, snap-fitted components, hook and loop fasteners, magnetic fasteners, buckles, interference fits (press fits), dove tails, ropes, threads, cable ties such as zip ties or wires, magnetic fasteners, clamps, adhesives, and/or any combination thereof. Given by way of example and not of limitation, bolts and anchors, such as WingIts® brand MASTER Anchor™ series anchors, toggle bolts like Snaptoggle® heavy-duty toggle bolts or Flip-Toggle® anchors, wall anchors such as E-Z Ancor®, molly bolts, anchors like Tapcon® concrete screws, wedge anchors or rawl plugs, and so on. As such, once the fasteners 150 have secured the plate 300 to the mount 400 and the mount 400 to the upstanding structure, the alignment guide 500 may be removed entirely by pulling it up and out of a space between the mount 400 and the upstanding structure or wall. This process may thus be described as placing the alignment guide 500 on the sturdy portion of the upstanding structure, leveling the alignment guide 500, placing the mount 400 in a receiving portion of the alignment guide 500, securing the mount 400 to the upstanding structure with the fasteners 150, and removing the alignment guide 500. Note that in the figures the plate 300 and the mount 400 include an aperture at the bottom that is roughly stadium-shaped rather than circular. This allows for slight movement during installation of the mount 400 to be tilted in the even the initial fastener points marked on the wall were not perfectly vertical. While the placement guide 200 is designed to assist with near-perfect vertical placement of fastener points, human error does still happen and as such if the fastener points were positioned slightly off kilter and were holes in the wall, then the installation of the mount onto the wall could allow for screws or nails etc. to be placed therethrough and inserted into the fastener points in the wall (though slightly off-vertical) and the mount 400 could still be rotated slightly and adjusted to be perfectly vertical with assistance of the alignment guide 500.

It should be noted that the mount 400 can be attached to the wall or upstanding structure without the plate 300. Removing the plate 300 will reduce weight strain on the wall for when the basketball hoop 600 is not in use.

After securing the mount 400 to the wall with the plate 300 attached, the basketball hoop 600 will then have the magnet placed within the magnet housing and the cap 700 will secure the magnet 800 therein. The basketball hoop 600 is then ready for use and play by inserting the cylindrical protrusions 620 into the hook holders 440. The magnet 800 will hold the basketball hoop 600 up against the plate 300 and the basketball hoop may be rotated downward by pulling the magnet 800 away from the plate 300 while still permitting the basketball hoop 600 to be hung in the air by the mount 400 rather than falling to the ground.

Figure 14:
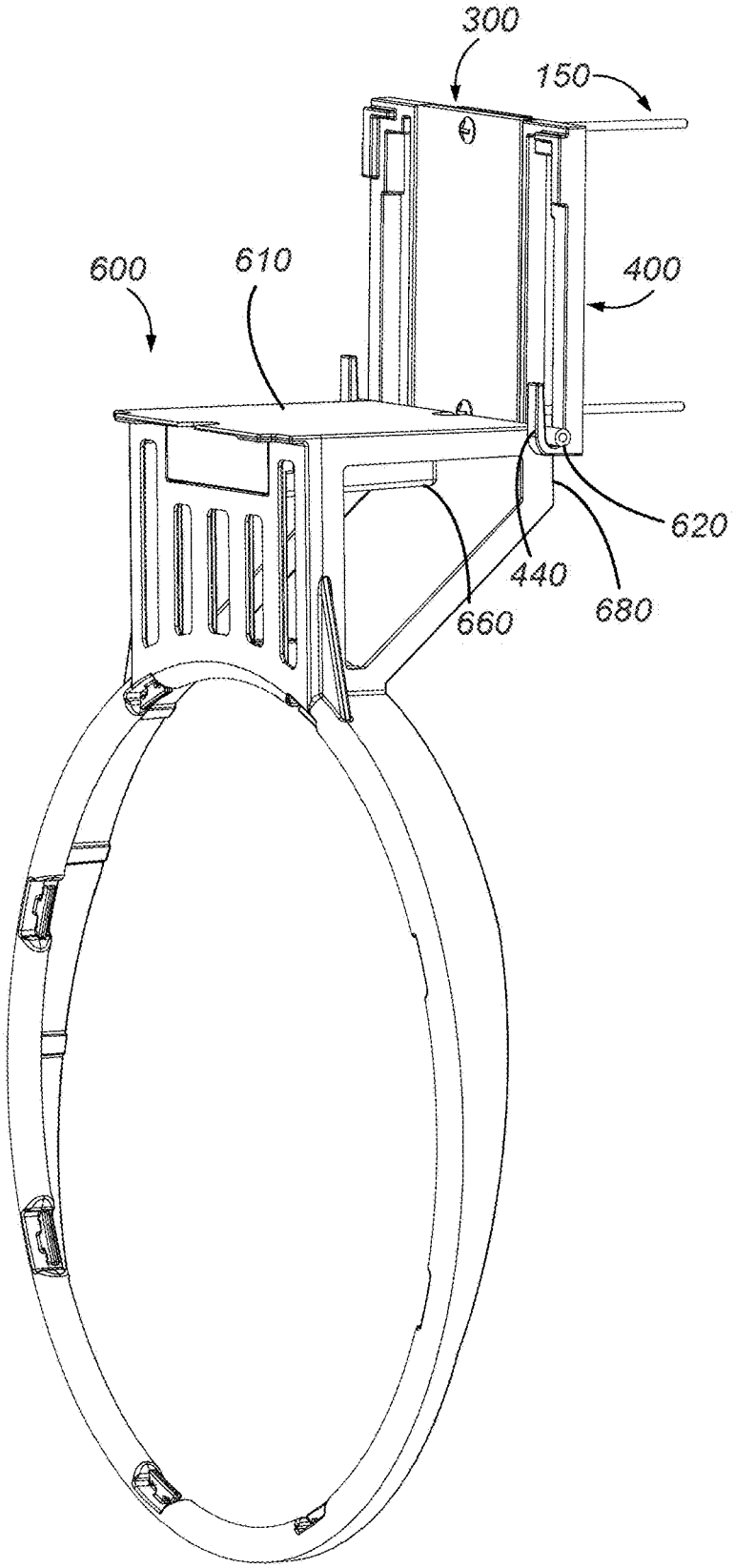
FIG. 14 shows a perspective view of the basketball hoop of FIG. 6A and mount of FIG. 4A in a non-use position.

FIGS. 12-15 show in more detail how the hoop 600 rotates downward (and upward if in reverse) with relation to the mount 400. As shown, the basketball hoop 600 is in a use position in FIG. 12, in a partially rotated position in FIG. 13, and the basketball hoop 600 is in a fully rotated downward position in FIG. 14. As shown in FIG. 14 in the fully rotated downward position, the rim 640 is substantially parallel with the mounting base 410. As mentioned in conjunction with the discussion of FIGS. 6A-6H, the flat bracket 680 interfaces with the mounting body 410 so as to reduce possible further movement, or further rotation, past the 90-degrees of rotation for the hoop 600 from the use position to the non-use position as shown in FIGS. 11-14 respectively. This 90-degrees of rotation can symbolically be seen by an angle formed between the base portion 610 of the basketball hoop 600 with respect to the steel plate 300 shown in FIG. 14, and in FIG. 12 this angle would be ( ) degrees as the base portion 610 and the steel plate 300 are parallel to and flat against one another in this position.

Further, note that an axis of rotation between FIGS. 11-14 is about an axis defined by the cylindrical protrusions 620 in which they rotate within the hook holders 440. Another point to note is that the magnets 800 do not fall out of the magnet housing 660 during rotation of the hoop 600 to the non-use position because the cap 700 is in place.

Figure 15:
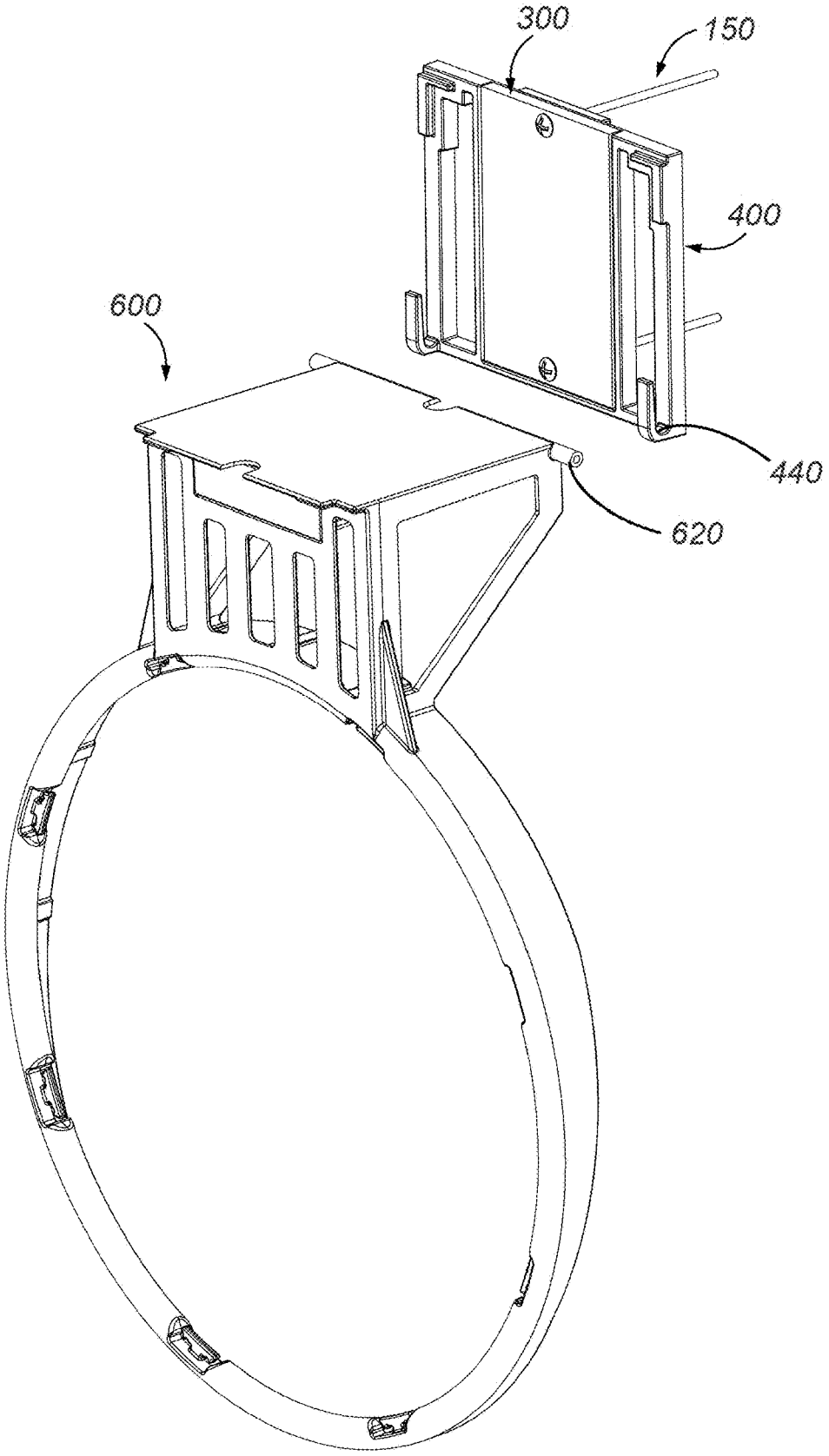
FIG. 15 shows a perspective view of the basketball hoop of FIG. 6A removed from the mount of FIG. 4A.

Furthermore. FIG. 15 shows the ease with which the hoop 600 may be removed from the mount 400 once the hoop 600 has rotated to the non-use position. As the hook holders 440 include openings at a top of the hook holders 440 the cylindrical protrusions 620 may easily be lifted out so as to remove the hoop 600, while at the same time a length of the hook holders 440 is long enough such that the hoop 600 will not accidentally fall off or be removed from the mount 400 when the hoop 600 rotates downward. Given by way of example and not of limitation a length of the hook holders 440 may be a half-inch or longer. This in no way limits having hook holders 440 to being a shorter length. As shown in FIG. 15, once the hoop 600 is removed the only remaining components on the wall will be the fasteners 150, the mount 400, and the steel plate 300, in which the steel plate 300 can also be removed for reduced weight of the remaining components.

Figure 16A:
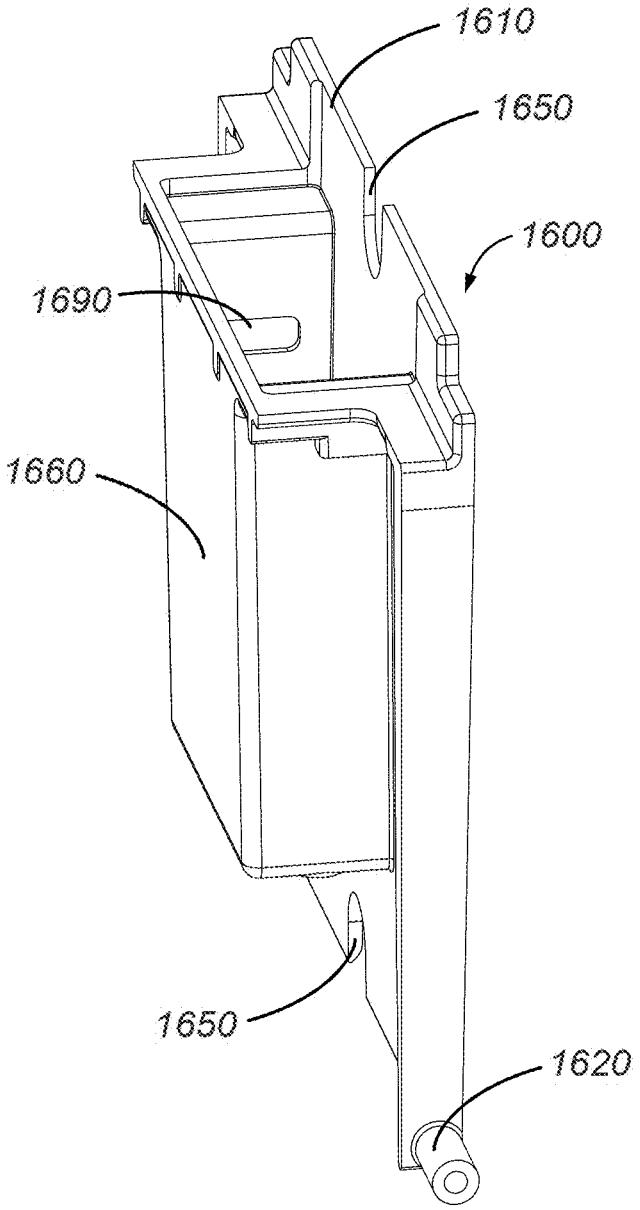
FIG. 16A shows a perspective view of an alternative hoop foundation compatible with a snap cap of FIG. 17A.
Figure 16B:
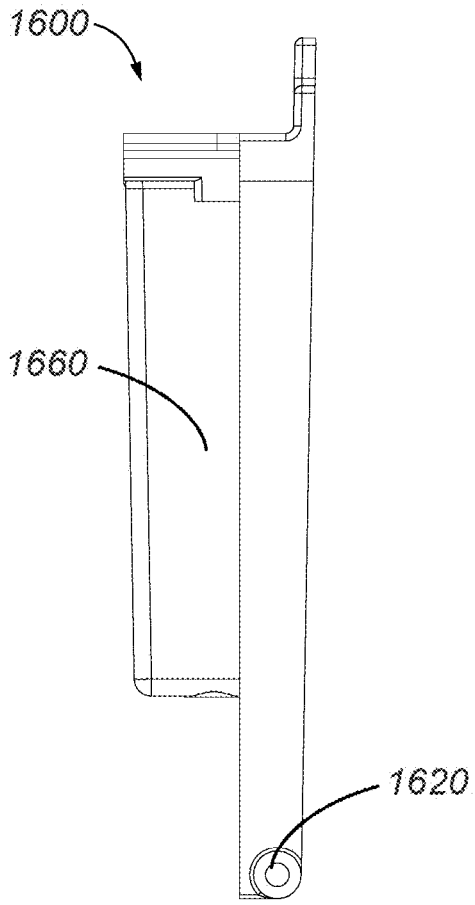
FIG. 16B shows a side elevation view of the alternative hoop foundation of FIG. 16A.
Figure 16C:
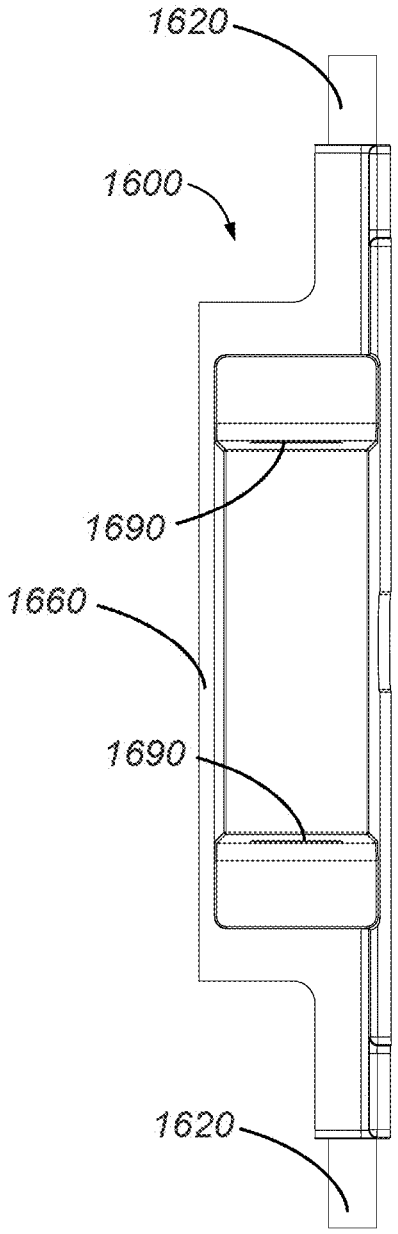
FIG. 16C shows a top elevation view of the alternative hoop foundation of FIG. 16A.

FIGS. 16A-16C show an alternative hoop foundation 1600. The alternative hoop foundation 1600 may include a base portion 1610, cylindrical protrusions 1620, a frame 1630 (not shown), a rim 1640 (not shown), cutouts 1650, a magnet housing 1660, a bridge 1670 (not shown), a flat bracket 1680 (not shown), and recesses 1690.

As can be seen in FIGS. 16A and 16C, the alternative hoop foundation 1600 specifically includes the recesses 1690 within the magnet housing 1660 as opposed to the hoop 600 which does not include the cutouts 1650. In this regard, the alternative hoop foundation is configured to receive a cap that may be permanently snap-fitted in place to permanently house the magnet 800. The alternative hoop foundation 1600 is shown without the rim 1640 etc. as opposed to figures showing the hoop 600 so as to get a zoomed in view of the recesses 1690 and their placement.

Figure 17A:
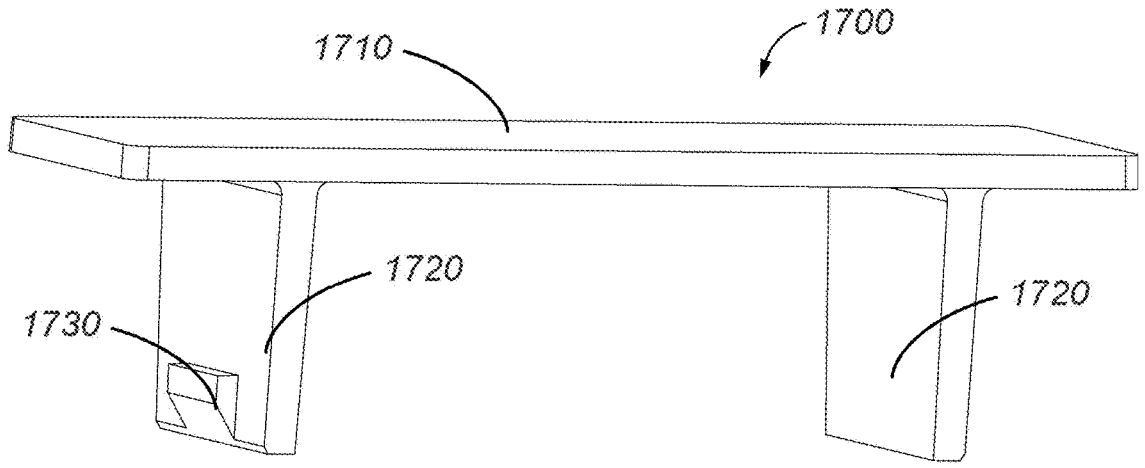
FIG. 17A shows a perspective view of a snap cap.
Figure 17B:
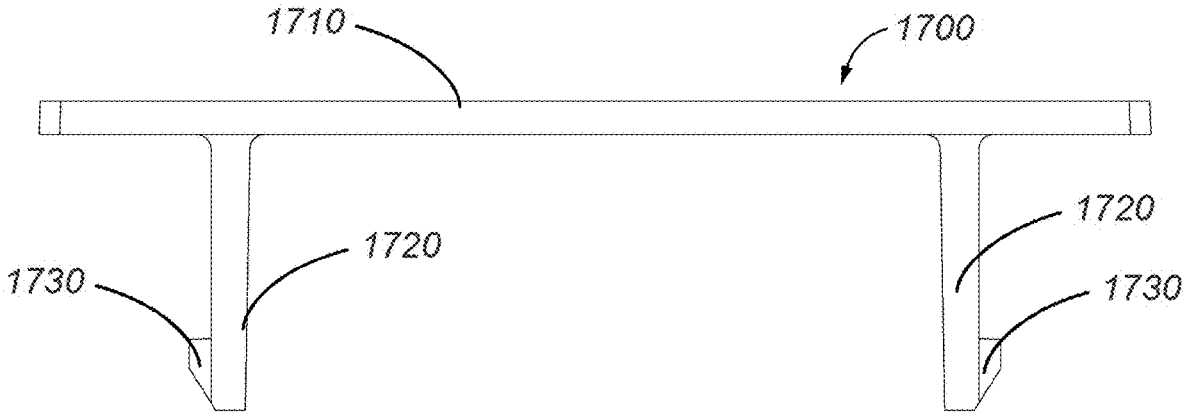
FIG. 17B shows a side elevation view of the snap cap of FIG. 17A.
Figure 17C:
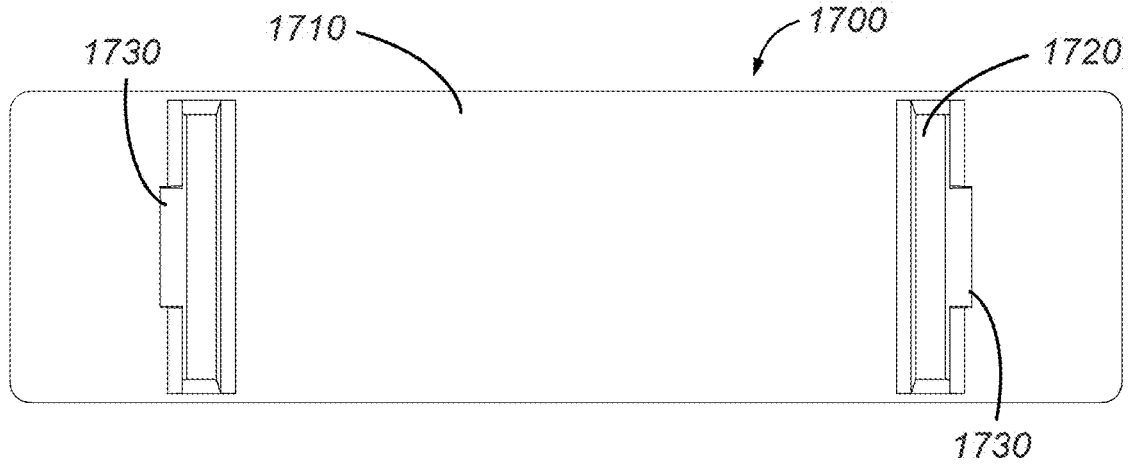
FIG. 17C shows a bottom plan view of the snap cap of FIG. 17A.

FIGS. 17A-17C show a snap cap 1700. The snap cap 1700 includes a fit portion 1710, a top 1720, and snaps 1730. The snaps 1730 can be seen extending from the fit portion 1710 outwardly so as to snap into place within the recesses 1690 of the alternative hoop mount 1600 when the fit portion 1710 slidingly engages an interior of the magnet housing 1660. In this regard, the snap cap 1700 will be permanently affixed to the magnet housing 1660 so as to keep the magnet 800 contained within an unable of being removed by a user of the system 1000 without cutting through the metal of the hoop 1600.

There are numerous benefits to the present disclosure. First and foremost, the present disclosure allows for a basketball hoop that not only can be used in an indoor setting, but when aggressive basketball play ensues and a player attempts to dunk a basketball into the hoop, the basketball hoop 600 will simply rotate downward rather than cause strain on the wall or upstanding structure to which the basketball system is attached. In college dorms, there is all-to-prevalent a problem of tearing a hole in a wall of an apartment by friends horsing around and dunking on basketball hoops installed on the wall that have no way of reducing strain exerted on the wall when a basketball dunk happens. This rotation of the basketball hoop 600 increases longevity of wall health for buildings at least in this regard.

Further, the basketball hoop 600 may completely be removed without removing the mounting base of the basketball system. A result of this is rather significant. The mount 400 may remain attached to the wall, and due to the mount being level and squared-off at a top of the mount 400, picture frames and canvases can be hung on the mount 400 to be perfectly level and no new holes would need to be inserted into the wall (thus increasing wall integrity), and the mount would remain entirely hidden. In true college dorm fashion, a college student could take down the basketball hoop 600 by simply lifting up and removing the cylindrical protrusions from the hook holders 440, and then even without removing the plate 330 a nice picture frame could be put in place instead, hung from the mount 400 when distinguished guests come to visit. If on the other hand the basketball hoop 600 is in long-term non-use, then the plate 300 could also be removed so as to reduce weight and retain an improved wall integrity while a picture is hung on the mount 400. Importantly, the hook holders 440 do not extend further out than typical pictures do from a frame in which the picture is positioned or a distance of a canvas picture from the frame positioned behind the canvas. As such, the hook holders 440 will not interfere with a picture that is hung from the mount 400.

A further benefit of the present disclosure provides an ability to easily swap out various backboards for use with the basketball hoop 600. Sturdy materials such as cardboard may include a cutout that matches the cutout 540 of the alignment guide. As such, backboards of different designs may be alternated in and out for use as easily as the alignment guide 500 may be inserted and removed from a distance between the mount 400 and the wall by placing them on the alignment portion 430 of the mount 400. For example, one backboard may include an image of Michael Jordan extending across the backboard, while another backboard may include an image of LeBron James, wherein the Michael Jordan backboard may be removed and the LeBron James backboard inserted depending on a mood of the user or which guests the user may have over. The backboard need only have a thickness thinner than the distance between the mount 400 and the wall and include a cutout a same shape as the alignment guide's cutout 540. By meeting these two requirements, backboards of various shapes, sizes, and designs may be swapped in or out for use with the basketball hoop 600 creating more diverse gameplay and increased fun.

It is important to note that for this most previously mentioned benefit that the alignment portion 430 of the mount 400 need not align anything or even be associated with the alignment guide 500. Rather. "alignment portion" similar to the hook holders 440, is simply a name for that portion of the mount 400 and is not limited by this name. Meaning, because the various backboards can be positioned on the mount 400 by inserting onto the alignment portion 430 the same as the alignment guide 500, the alignment portion 430 could equally be called a backboard holder. Further, the alignment portion 430 functioning as the backboard holder could comprise a plurality of backboard holders. This is possible in various ways, including for example, given by way of example and not of limitation, a plurality of vertical and straight protrusions (much like a white-picket fence) extending from the mounting base 410 of the mount for cutouts in the backboards to interlock with. There could similarly be a first backboard holder and a second backboard holder on a first side and a second side of the mount 400 extending from the mounting base 410. As such, just because the alignment portion 430 is called the "alignment portion" does not limit it solely to the function of aligning the mount with the alignment guide. Rather, this functions solely as a name for consistency throughout the specification as with other names given to the components described herein.

Nylon bristle, nylon brush, rubber squeegee, and other magnet free attachment mechanisms, may for example be used to create hoops that can be utilized by individuals with pacemakers and/or other devices that are adversely affected by magnets. For example, in a nylon bristle embodiment not using magnets, a series of nylon brushes are positioned to drop down and engage the base portion 610 of the basketball hoop 600 in which case the hoop 600 would be upheld by the nylon brushes exerting a biasing force on the base portion 610 towards the mount 400. In such a case, the hoop 600 would be releasable so as to place the hoop 600 in a downward or non-use state by exerting force in a direction to rotate the hoop 600 enough to bend the nylon bristles such that the nylon brushes would release the base portion 610 and no longer exert any biasing force on the hoop 600 thus allowing the hoop 600 to rotate fully downward influenced only by gravity and a connection between the cylindrical protrusions 620 and the hook holders 440. A similar configuration is possible for example by use of a rubber squeegee much like a window squeegee (in shape) in which the rubber squeegee would be positioned on the mount 400 above where the base portion 610 comes in contact with the mount 400 while slightly overlapping with an area upon which the base portion 610 would contact the mount 400. In this configuration the rubber squeegee would pin the base portion 610 against the mount 400 (the mount on a first side of the base portion 610 and the rubber squeegee on a second side, opposite the first side, of the base portion 610) when the base portion 610 is pushed into a vertical position, past the rubber squeegee, and the base portion 610 would be releasable by exerting a force on the hoop 600 so as to rotate the hoop 600 downward and the rubber squeegee would bend until releasing the base portion 610 from being biased towards the mount 400.

From the foregoing, it can be seen that the present disclosure accomplishes at least all of the stated objectives.

LIST OF REFERENCE CHARACTERS

The following table of reference characters and descriptors are not exhaustive, nor limiting, and include reasonable equivalents. If possible, elements identified by a reference character below and/or those elements which are near ubiquitous within the art can replace or supplement any element identified by another reference character.

TABLE 1

| List of Reference Characters | |
|---|---|
| 100 | mounting system |
| 150 | fasteners |
| 200 | placement guide |
| 210 | placement base |
| 220 | flange |
| 230 | leveler |
| 240 | locator sleeves |
| 250 | apertures |
| 300 | plate |
| 310 | apertures |
| 400 | mount |
| 410 | mounting base |
| 420 | plate receiving portion |
| 430 | alignment portion |
| 440 | hook holders |
| 450 | protrusions |
| 460 | apertures |
| 470 | weight reduction portions |
| 500 | alignment guide |
| 510 | alignment base |
| 520 | flange |
| 530 | connection points |
| 540 | cutout |
| 600 | basketball hoop |
| 610 | base portion |
| 620 | cylindrical protrusions |
| 630 | frame |
| 640 | rim |
| 650 | cutouts |
| 660 | magnet housing |
| 670 | bridge |
| 700 | cap |
| 710 | fit portion |
| 720 | top |
| 800 | magnet |
| 900 | backboard (e.g. interchangeable backboard) |
| 1000 | basketball hoop system |
| 1050 | basketballs |
| 1060 | first ball |
| 1070 | second ball |
| 1080 | third ball |
| 1100 | snap clasp |
| 1110 | male snap |
| 1120 | female snap |
| 1130 | foundation |
| 1140 | folding line |
| 1200 | net |
| 1600 | alternative hoop foundation |
| 1610 | base portion |
| 1620 | cylindrical protrusions |
| 1630 | frame |
| 1640 | rim |
| 1650 | cutouts |
| 1660 | magnet housing |
| 1670 | bridge |
| 1680 | flat bracket |
| 1690 | recesses |
| 1700 | snap cap |
| 1710 | top |
| 1720 | fit portion |
| 1730 | snaps |

GLOSSARY

Unless defined otherwise, all technical and scientific terms used above have the same meaning as commonly understood by one of ordinary skill in the art to which embodiments of the present disclosure pertain.

The terms "a," "an," and "the" include both singular and plural referents.

The term "or" is synonymous with "and/or" and means any one member or combination of members of a particular list.

As used herein, the term "exemplary" refers to an example, an instance, or an illustration, and does not indicate a most preferred embodiment unless otherwise stated.

The term "about" as used herein refers to slight variations in numerical quantities with respect to any quantifiable variable. Inadvertent error can occur, for example, through use of typical measuring techniques or equipment or from differences in the manufacture, source, or purity of components.

The term "substantially" refers to a great or significant extent. "Substantially" can thus refer to a plurality, majority, and/or a supermajority of said quantifiable variables, given proper context.

The term "generally" encompasses both "about" and "substantially."

The term "configured" describes structure capable of performing a task or adopting a particular configuration. The term "configured" can be used interchangeably with other similar phrases, such as constructed, arranged, adapted, manufactured, and the like.

Terms characterizing sequential order, a position, and/or an orientation are not limiting and are only referenced according to the views presented.

The "invention" is not intended to refer to any single embodiment of the particular invention but encompass all possible embodiments as described in the specification and the claims. The "scope" of the present disclosure is defined by the appended claims, along with the full scope of equivalents to which such claims are entitled. The scope of the disclosure is further qualified as including any possible modification to any of the aspects and/or embodiments disclosed herein which would result in other embodiments, combinations, subcombinations, or the like that would be obvious to those skilled in the art.

What is claimed is:

1. A basketball mounting kit, comprising:

a placement guide comprising:

a placement base;

a flange extending a first direction from the placement base;

a leveler positioned on the flange; and at least two locator sleeves extending substantially orthogonal from the placement base in the first direction, wherein the at least two locator sleeves define a line perpendicular to the leveler;

a mount for attaching to an upstanding structure comprising:

a mounting base including a top and a bottom;

an alignment portion extending from a first side of the mounting base, the alignment portion including substantially straight sides;

at least two apertures extending through the mounting base, the at least two apertures defining a line perpendicular to a surface of the top of the mounting base; and at least two hook holders positioned at the bottom of the mounting base extending from a second direction of the mount, the at least two hook holders each comprising substantially an L-shape;

an alignment guide comprising:

an alignment base;

a flange extending a first direction from the alignment base;

a leveler positioned on the flange; and a cutout within the alignment base shaped to surround the alignment portion of the mount and to slidingly engage the alignment portion; and a basketball hoop comprising:

a base portion;

a pair of cylindrical protrusions extending substantially parallel from the base portion on a first side and a second side of the base portion;

a rim;

a frame connecting the rim to the base portion; and a magnet housing positioned on the base portion with a magnet positioned therein.

* * * * *